United States Patent [19]

Toya et al.

[11] Patent Number: 5,015,562

[45] Date of Patent: May 14, 1991

[54] LIGHT-SENSITIVE SILVER HALIDE ELEMENT CONTAINING MODANT, DYE AND SONIC POLYMER

[75] Inventors: Ichizo Toya; Sumito Yamada, both of Kanagawa; Koichi Suematsu, Shizuoka, all of Japan

[73] Assignee: Fuji Photo Film Co., Ltd., Kanagawa, Japan

[21] Appl. No.: 596,620

[22] Filed: Oct. 12, 1990

Related U.S. Application Data

[63] Continuation of Ser. No. 321,823, Mar. 9, 1989, abandoned.

[30] Foreign Application Priority Data

Mar. 9, 1988 [JP] Japan ..... 63-55585
Jun. 7, 1988 [JP] Japan ..... 63-139901

[51] Int. Cl.[5] ..... G03C 1/06

[52] U.S. Cl. ..... 430/518; 430/517; 430/523; 430/521; 430/529; 430/634; 430/635

[58] Field of Search ..... 430/517, 518, 523, 521, 430/529, 634, 635

[56] References Cited

U.S. PATENT DOCUMENTS

| | | | |
|---|---|---|---|
| 3,282,698 | 11/1966 | Jones et al. | 430/518 |
| 3,709,692 | 1/1973 | Cohen et al. | 430/518 |
| 3,788,855 | 1/1974 | Cohen et al. | 430/518 |
| 4,193,795 | 3/1980 | Campbell et al. | 430/518 |
| 4,353,972 | 10/1982 | Helling et al. | 430/518 |
| 4,379,838 | 4/1983 | Helling et al. | 430/518 |
| 4,721,666 | 1/1988 | Yamanouchi et al. | 430/518 |

*Primary Examiner*—Jack P. Brammer
*Attorney, Agent, or Firm*—Sughrue, Mion, Zinn, Macpeak & Seas

[57] ABSTRACT

A light-sensitive material is disclosed, comprising a support having thereon at least one light-sensitive silver halide emulsion layer, wherein at least one layer containing at least one of a mordant and a dye is provided on at least one side of the support, and at least one layer which is provided on the same side of the layer containing the mordant and dye contains a water-soluble ionic polymer as an agent for reducing color remaining. The light-sensitive material has improved sharpness, freedom from color remaining after processing, and excellent drying properties suitable for rapid processing.

11 Claims, No Drawings

LIGHT-SENSITIVE SILVER HALIDE ELEMENT CONTAINING MODANT, DYE AND SONIC POLYMER

This is a continuation of application Ser. No. 07/321,823, filed Mar. 9, 1989, now abandoned.

FIELD OF THE INVENTION

The present invention relates to a light-sensitive material having improved image quality, particularly sharpness, freedom from residual color, and excellent drying properties suitable for rapid processing, particularly ultra-rapid processing requiring a dry-to-dry time of from 30 to 60 seconds.

The light-sensitive materials of the present invention are useful as medical films, such as X-ray film for direct radiography.

BACKGROUND OF THE INVENTION

It has been of high interest in the field of photography to improve image quality. It is known that image sharpness can be improved by incorporating a mordant and a dye into light-sensitive materials to thereby prevent irradiation and halation.

Use of the dye, however, is attended by the problem that the dye is not sufficiently removed during processing to cause residual color.

Residual color may be prevented by combining a dye with a mordant having weak mordanting capability, but such an approach has the disadvantage that the dye undergoes diffusion during coating, resulting in reduction of sensitivity.

On the other hand, developments in light-sensitive materials and processing agents have contributed to a considerable reduction in development time. It is usually desired, whether for professionals or amateurs, to see the finished photographs as soon as possible. In the field of printing, particularly for those in informational media, it is eagerly demanded to reduce the processing time of light-sensitive materials in order to give information quickly. Reduction of processing time is also very important in the field of medical photography, since diagnosis and treatment should be done without delay in case of emergency.

Reduction in processing time is realized by shortening the time for each of a series of processing steps including development, fixation, washing, and drying. For example, it is generally known that development time can be reduced by a method of heightening activity of a developer, e.g., by increasing the amount of a development agent or elevating the pH or the processing temperature; or by a method of accelerating the rate of development of a silver halide emulsion per se.

The time for washing or drying greatly depends on the thickness and degree of swelling of a coated film. The time may be shortened by using, as a binder, gelatin whose crosslinkability has been increased by addition of a sufficient amount of a hardening agent. However, this method reduces the covering power of the silver halide, thus requiring an increase in silver coverage, or results in reduction of sensitivity, delay of development, and reduction of the rate of fixation. To increase the amount of the binder, therefore, leads to considerable difficulties in rapid processing.

In direct radiography for medical use, for the purpose of decreasing the exposed dose of X-rays harmful to the human body, X-ray films generally have a support having an emulsion layer provided on both sides thereof, and a radiographic intensifying screen is set on both surfaces of the film to obtain a considerable degree of intensification. A disadvantage associated with this radiographic system is called a "cross-over phenomenon". That is, the light emitted from each of the intensifying screens is not only projected onto the respective silver halide emulsion layer which is in contact with the screen but also transmitted through the emulsion layer and the support to become scattered light which reaches the emulsion layer on the opposite side to form an image having low sharpness. In an attempt to overcome the cross-over phenomenon, it has been proposed to add a magenta dye or a yellow dye to an orthochromatic light-sensitive material to improve sharpness as disclosed in U.S. Pat. No. 4,130,429 and JP-A-61-116354 and JP-A-61-116349 (the term "JP-A" as used herein refers to a "published unexamined Japanese patent application"). However, mere addition of a dye to a silver halide emulsion layer inevitably results in considerable photographic desensitization due to its optical absorption. Hence, such a dye is added to an interlayer provided between the silver halide emulsion layer and the support. Nevertheless, formation of such an interlayer causes diffusion of the dye on coating of the emulsion layer, which leads to more or less photographic desensitization. To make matters worse, provision of an interlayer requires gelatin or any other binder in significant quantities, and drying properties of the light-sensitive material are deteriorated due to the increase of the binder amount, thus reducing suitability for rapid processing.

In order to cope with the above-described problems, JP-A-62-70830 and JP-A-55-33172 disclose techniques in which a water-soluble dye which can be decolored during photographic processing is fixed in a subbing layer provided on a support by use of a basic high polymeric mordant. Although these techniques are very effective, it has conventionally been difficult to sufficiently fix the water-soluble dye in a gelatin layer, since the gelatin content of a subbing layer is generally as small as 0.5 g/m$^2$ or even less.

SUMMARY OF THE INVENTION

Accordingly, one object of the present invention is to provide a light-sensitive material having improved sharpness and freedom free residual color while retaining sufficient sensitivity.

Another object of the present invention is to provide a light-sensitive material which exhibits excellent fixing properties, high sensitivity, and suitability for rapid processing.

A further object of the present invention is to provide a light-sensitive material for medical use which has high sharpness, freedom from color remaining, and suitability for ultra-rapid processing.

As a result of extensive investigations, it has now been found that these and other objects of the present invention can be accomplished by providing at least one layer containing a mordant and a dye on at least one side of a support and incorporating a water-soluble ionic polymer into a layer provided on the same side of the layer containing the mordant and dye.

Accordingly, the present invention relates to a light-sensitive material comprising a support having thereon at least one light-sensitive silver halide emulsion layer, wherein at least one layer containing at least one of a mordant and a dye is provided on at least one side of the support, and at least one layer which is provided on the same side of the layer containing the mordant and dye contains a water-soluble ionic polymer as an agent for reducing color remaining.

DETAILED DESCRIPTION OF THE INVENTION

The water-soluble ionic polymer serving as an agent for reducing color remaining (i.e., an agent for reducing residual color) according to the present invention includes synthetic water-soluble polymers containing a repeating unit represented by formula (P) shown below, and naturally-occurring water-soluble ionic polymers and derivatives thereof.

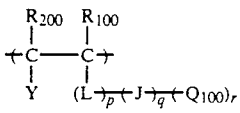

(P)

wherein $R_{100}$ and $R_{200}$, which may be the same or different, each represents hydrogen, a substituted or unsubstituted alkyl group (preferably having from 1 to 4 carbon atoms, e.g., methyl, ethyl, propyl, butyl), a halogen atom (e.g., chlorine), or $—CH_2COOM$, wherein M represents hydrogen or a cation; L represents —CONH—, —NHCO—, —COO—, —OCO—, —CO—, $—SO_2—$, $—NHSO_2—$, $—SO_2NH—$ or —O—; J represents a substituted or unsubstituted alkylene group (preferably having from 1 to 10 carbon atoms, e.g., methylene, ethylene, propylene, trimethylene, butylene, hexylene), a substituted or unsubstituted arylene group (e.g., phenylene), a substituted or unsubstituted aralkylene group (e.g.,

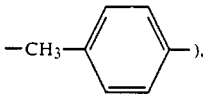

$-(CH_2CH_2O)_m—(CH_2)_n—$, or

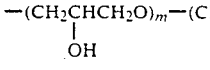

wherein m represents 0 or an integer of from 1 to 40, and n represents 0 or an integer of from 1 to 4; $Q_{100}$ represents —COOM, $—SO_3M$,

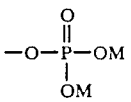

or —OM (preferably —COOM), wherein M represents hydrogen or a cation; p and q each represents 0 or 1; r represents an integer (preferably 1 or 2 and particularly preferably 1); and Y represents hydrogen or a carboxyl group (or a salt thereof).

Examples of substituents for the alkyl, alkylene, arylene and aralkylene groups include a methyl group and an ethyl group.

The synthetic water-soluble monomer containing the repeating unit of formula (P) may be a copolymer containing the monomer unit of formula (P) and a unit derived from a copolymerizable ethylenically unsaturated monomers. Examples of the copolymerizable ethylenically unsaturated monomer include styrene, alkylstyrenes or hydroxyalkylstyrenes having from 1 to 4 carbon atoms in their alkyl moiety (e.g., methyl, ethyl, butyl), vinylbenzenesulfonic acid or salts thereof, α-methylstyrene, N-vinylpyrrolidone, monoethylenically unsaturated esters of fatty acids (e.g., vinyl acetate, vinyl propionate), ethylenically unsaturated monocarboxylic acids or dicarboxylic acids or salts thereof (e.g., acrylic acid, methacrylic acid), maleic anhydride, ethylenically unsaturated monocarboxylic acid or dicarboxylic acid esters (e.g., n-butyl acrylate, dimethyl maleate) and ethylenically unsaturated monocarboxylic acid or dicarboxylic acid amides (e.g., acrylamide, sodium 2-acrylamido-2-methylpropanesulfonate).

Specific examples of the synthetic water-soluble polymers having a repeating unit of formula (P) are shown below, but the present invention is not to be construed as being limited thereto.

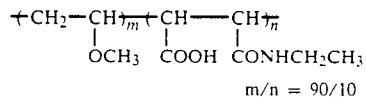

P-1 m/n = 90/10

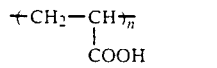

P-2 n = 100

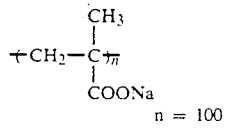

P-3 n = 100

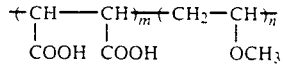

P-4 m/n = 5/95

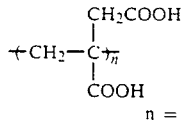

P-5 n = 100

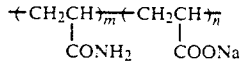

P-6 m/n = 90/10

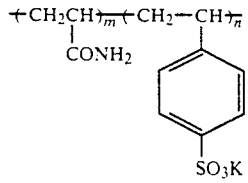

P-7 m/n = 95/5

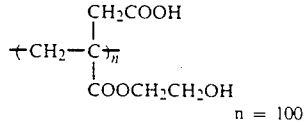

P-8 n = 100

-continued

P-9

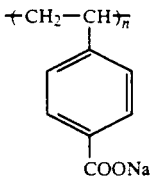

n = 100

P-10

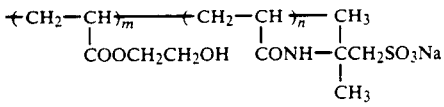

m/n = 40/10

P-11

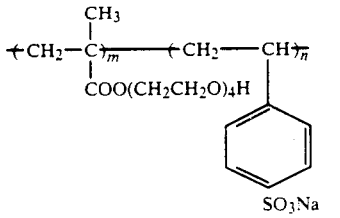

m/n = 50/50

P-12

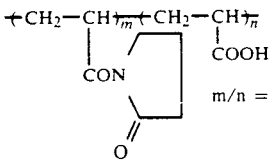

m/n = 97/3

P-13

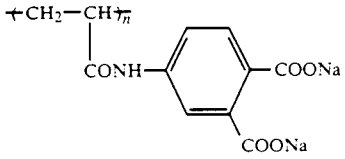

n = 100

P-14

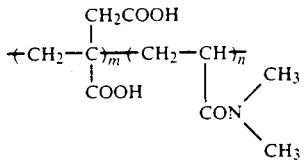

m/n = 15/85

P-15

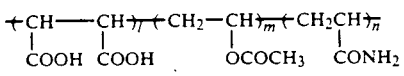

l/m/n = 15/25/60

P-16

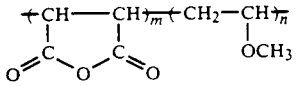

m/n = 50/1

The synthetic water-soluble polymers to be used in the present invention have a molecular weight of preferably from 1,000 to 1,000,000, more preferably from 2,000 to 300,000.

The naturally-occurring water-soluble ionic polymers which can be used in the present invention preferably include anionic polymers, such as alginic acid, gum arabic, pectic acid, and tragacanth gum.

Derivatives of the naturally-occurring water-soluble ionic polymers include dextran sulfate, a carboxyalkyl dextran, cellulose sulfate, a carboxyalkyl cellulose, pullulan sulfate, and a carboxyalkyl pullulan. These natural water-soluble ionic polymer derivatives preferably have a molecular weight of from 1,000 to 1,000,000, more preferably from 2,000 to 300,000.

These polymer derivatives can be prepared according to the processes described in JP-B-35-11989 (the term "JP-B" as used herein refers to an "examined Japanese patent publication"), U.S. Pat. No. 3,762,924, and JP-B-45-12820, JP-B-45-18418, JP-B-45-40149, and JP-B-46-31192.

Further, among the above water-soluble polymer to be used in the present invention comprising the synthetic water-soluble polymer and the naturally-occurring water-soluble ionic polymer, a preferred water-soluble polymer is a polymer containing a carboxylic acid monomer unit. The polymer containing a carboxylic acid monomer unit preferably includes those represented by formula (P-I):

$$\text{-}(A_0)_a(B_0)_b\text{-} \qquad \text{(P-I)}$$

wherein $A_0$ represents a monomer unit selected from acrylic acid, methacrylic acid, maleic acid, itaconic acid, carboxystyrene, alkali metal salts or ammonium salts of these carboxylic acids, and vinyl compounds represented by the following formula:

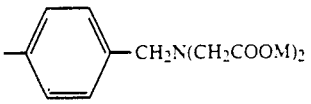

wherein M represents hydrogen or an alkali metal atom; $B_0$ represents a polymerizable monomer unit different from $A_0$; a is a copolymerization ratio of from 50 to 100 mol %; and b is a copolymerization ratio of from 0 to 50 mol %.

The unit $B_0$ preferably includes units derived from acrylamide, acrylic esters (e.g., methyl acrylate, ethyl acrylate, hydroxyethyl acrylate), methacrylic esters, and vinyl acetate.

The polymer containing the carboxylic acid monomer unit has an average molecular weight of generally from 2,000 to 500,000, preferably from 5,000 to 150,000.

Specific examples of preferred polymers containing the carboxylic acid monomer unit are shown below, but the present invention is not to be construed as being limited thereto.

P-I-1

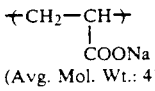

(Avg. Mol. Wt.: 41,000)

P-I-2

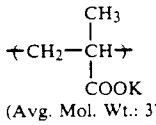

(Avg. Mol. Wt.: 37,000)

P-I-3

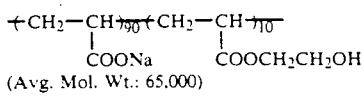

(Avg. Mol. Wt.: 65,000)

P-I-4

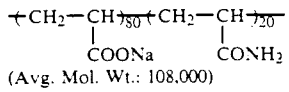

(Avg. Mol. Wt.: 108,000)

-continued

P-I-5

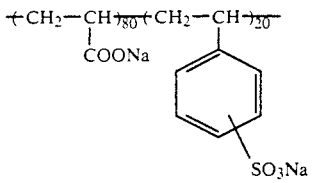

(Avg. Mol. Wt.: 32,000)

P-I-6

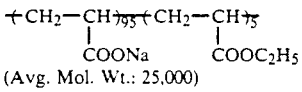

(Avg. Mol. Wt.: 25,000)

P-I-7

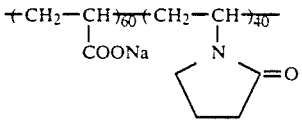

(Avg. Mol. Wt.: 79,000)

P-I-8

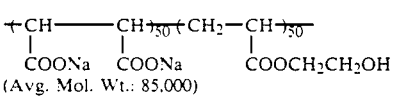

(Avg. Mol. Wt.: 85,000)

The residual color reducing agent (i.e., an agent for reducing color remaining) may be incorporated into any layer in the light-sensitive material, but is preferably in a layer other than the layer containing the mordant.

The amount of the residual color reducing agent to be added ranges preferably from 0.001 to 10 g/m$^2$, more preferably from 0.01 to 1 g/m$^2$, and most preferably from 0.05 to 0.8 g/m$^2$.

The mordant which can be used in the present invention preferably includes anion exchange polymers. The anion exchange polymers to be used include various known ammonium salt (or phosphonium salt) polymers. The ammonium salt (or phosphonium salt) polymers are widely known as mordanting polymers or antistatic polymers and include water-dispersible latex described in JP-A-59-166940, U.S. Pat. No. 958,995, and JP-A-55-142339, JP-A-54-126027, JP-A-54-155835, JP-A-53-30328, and JP-A-54-92274; polyvinyl pyridinium salts described in U.S. Pat. Nos. 2,548,564, 3,148,061, and 3,756,814; water-soluble ammonium salts described in U.S. Pat. No. 3,709,690; and water-soluble ammonium salt polymers described in U.S. Pat. No. 3,898,088.

Of these anion exchange polymers, preferred examples are those represented by formula (I):

(I)

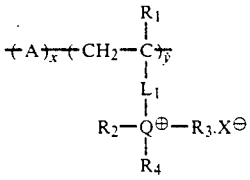

wherein A represents an ethylenically unsaturated monomer unit; $R_1$ represents hydrogen or a lower alkyl group having from 1 to about 6 carbon atoms; $L_1$ represents a divalent group having from 1 to about carbon atoms; $R_2$, $R_3$, and $R_4$, which may be the same or different, each represents a substituted or unsubstituted alkyl group having from 1 to about 20 carbon atoms, a substituted or unsubstituted aralkyl group having from 7 to about 20 carbon atoms, or hydrogen, and $R_2$, $R_3$, and $R_4$ may be linked to form a cyclic structure together with Q (and preferably only one of $R_2$, $R_3$, and $R_4$ is hydrogen from the standpoint of reduction of residual color); Q represents N or P; $X^{\ominus}$ represents an anion except for an iodide ion; x represents a copolymerization ratio from 0 to about 90 mol %; and y represents a copolymerization ratio from about 10 to 100 mol %.

Specific examples of the ethylenically unsaturated monomer represented by A include olefins (e.g., ethylene, propylene, 1-butene, vinyl chloride, vinylidene chloride, isobutene, vinyl bromide), dienes (e.g., butadiene, isoprene, chloroprene), ethylenically unsaturated esters of fatty acids or aromatic carboxylic acids (e.g., vinyl acetate, allyl acetate, vinyl propionate, vinyl butyrate, vinyl benzoate), esters of ethylenically unsaturated acids (e.g., methyl methacrylate, butyl methacrylate, t-butyl methacrylate, cyclohexyl methacrylate, benzyl methacrylate, phenyl methacrylate, octyl methacrylate, amyl acrylate, 2-ethylhexyl acrylate, benzyl acrylate, dibutyl maleate, diethyl fumarate, ethyl crotonate, methylene dibutyl malonate), styrenes (e.g., styrene, α-methylstyrene, vinyltoluene, chloromethylstyrene, chlorostyrene, dichlorostyrene, bromostyrene), and unsaturated nitriles (e.g., acrylonitrile, methacrylonitrile, allyl cyanide, crotononitrile). In view of emulsification polymerizability and hydrophobic properties, styrenes and methacrylic esters are particularly preferred. The monomer unit A may contain two or more units of the above-enumerated monomers.

$R_1$ preferably represents hydrogen or a methyl group from the standpoint of polymerization reactivity.

$L_1$ preferably represents

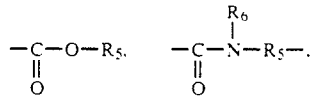

or

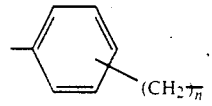

wherein $R_5$ represents an alkylene group (e.g., methylene, ethylene, trimethylene, tetramethylene), an arylene group, an aralkylene group (e.g.,

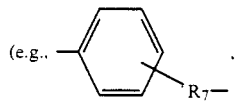

wherein $R_7$ represents an alkylene group having from 0 to about 6 carbon atoms); $R_6$ represents hydrogen or $R_2$ as defined above; and n represents an integer of 1 or 2. More preferred are

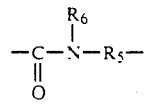

and

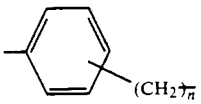

in view of alkali resistance. In view of emulsification polymerizability,

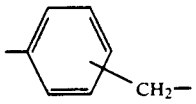

is the most preferred.

Q preferably represents N in view of reduced toxicity of a raw material.

X⊖, an anion other than an iodide ion, includes a halogen ion (e.g., chloride, bromide), an alkyl sulfate ion (e.g., methyl sulfate, ethyl sulfate), an alkyl- or arylsulfonate ion (e.g., methanesulfonate, ethanesulfonate, benzenesulfonate, p-toluenesulfonate), a nitrate ion, an acetate ion, and a sulfate ion. Particularly preferred are chloride, alkyl sulfate, arylsulfonate and sulfate ions.

The alkyl group represented by $R_2$, $R_3$, or $R_4$ includes an unsubstituted alkyl group (e.g., methyl, ethyl, propyl, isopropyl, t-butyl, hexyl, cyclohexyl, 2-ethylhexyl, dodecyl) and a substituted alkyl group, such as an alkoxyalkyl group (e.g., methoxymethyl, methoxybutyl, ethoxyethyl, butoxyethyl, vinyloxyethyl), a cyanoalkyl group (e.g., 2-cyanoethyl, 3-cyanopropyl), a halogenated alkyl group (e.g., 2-fluoroethyl, 2-chloroethyl, perfluoropropyl), an alkoxycarbonylalkyl group (e.g., ethoxycarbonylmethyl), an allyl group, a 2-butenyl group, and a propargyl group. These alkyl groups preferably contain from 1 to 12 carbon atoms.

The aralkyl group represented by $R_2$, $R_3$ or $R_4$ includes an unsubstituted aralkyl group (e.g., benzyl, phenethyl, diphenylmethyl, naphthylmethyl) and a substituted aralkyl group, such as an alkylaralkyl group (e.g., 4-methylbenzyl, 2,5-dimethylbenzyl, 4-isopropylbenzyl, 4-octylbenzyl), an alkoxyaralkyl group (e.g., 4-methoxybenzyl, 4-pentafluoropropenyloxybenzyl, 4-ethoxybenzyl), a cyanoaralkyl group (e.g., 4-cyanobenzyl, 4-(4-cyanophenyl)benzyl), and a halogenated aralkyl group (e.g., 4-chlorobenzyl, 3-chlorobenzyl, 4-bromobenzyl, 4-(4-chlorophenyl)benzyl). These aralkyl groups preferably contain from 7 to 14 carbon atoms.

The cyclic structure formed by $R_2$, $R_3$, $R_4$, and Q includes a structure of the following formula:

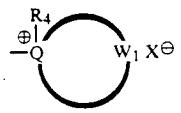

wherein $W_1$ represents an atomic group necessary to form an aliphatic heterocyclic ring together with Q; and $R_4$, Q and X⊖ are as defined above.

Examples of the aliphatic heterocyclic group include:

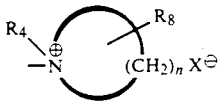

wherein $R_8$ represents hydrogen or $R_4$; n represents an integer of from 2 to 12; and $R_4$ and X⊖ are as defined above,

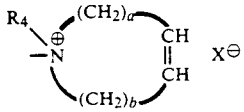

wherein a+b is an integer of from 2 to 7; and $R_4$ and X⊖ are as defined above,

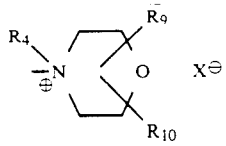

wherein $R_9$ and $R_{10}$ represents hydrogen or a lower alkyl group having from 1 to 6 carbon atoms; and $R_4$ and X⊖ are as defined above, and

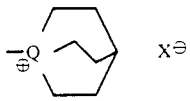

wherein Q and X⊖ are as defined above.

The cyclic structure formed by $R_2$, $R_3$, $R_4$, and Q further includes:

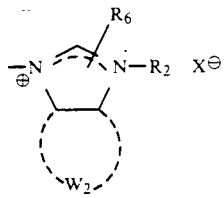

wherein $W_2$ represents an optional atomic group necessary for forming a benzene ring; and $R_2$, $R_6$, and X⊖ are as defined above,

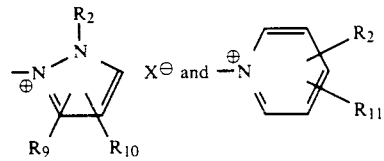

wherein $R_{11}$ represents hydrogen,

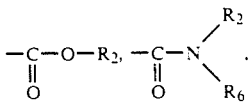

or $R_2$; when there are two $R_2$ groups, they may be the same or different; and $R_2$, $R_6$, $R_9$, $R_{10}$, and $X^{\ominus}$ are as defined above.

Preferred cyclic structures include

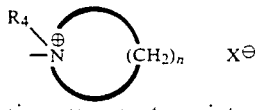

wherein n represents an integer of from 4 to 6; and $R_4$ and $X^{\ominus}$ are as defined above, and

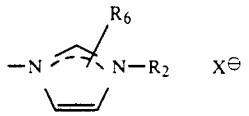

wherein $R_2$, $R_6$, and $X^{\ominus}$ are as defined above.

The y unit (the monomer unit at the right hand of formula (I)) may be composed of two or more different units.

x preferably ranges from 20 to 60 mol %, and y preferably ranges from 40 to 80 mol %.

In order to prevent the mordant from moving from a desired layer to another layer or into a processing solution and to avoid photographically unfavorable influences, it is particularly preferable to copolymerize with a monomer having at least 2 (preferably 2 to 4) ethylenically unsaturated groups to form an anion exchange polymer latex.

Such an anion exchange polymer latex preferably has a structure represented by formula (II):

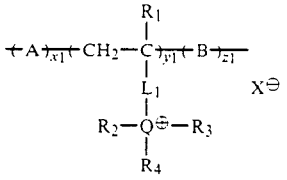

(II)

wherein A, $R_1$, $R_2$, $R_3$, $R_4$, $L_1$, Q, and $X^{\ominus}$ are as defined above; $x_1$ is a copolymerization ratio ranging preferably from 0 to 90 mol %, more preferably from 20 to 60 mol %; $y_1$ is a copolymerization ratio ranging preferably from 10 to 99.9 mol %, more preferably from 10 to 95 mol %; $z_1$ is a copolymerization ratio ranging preferably from 0.1 to 50 mol %, more preferably from 1 to 30 mol %; and B represents a structural unit derived from a copolymerizable monomer containing at least two ethylenically unsaturated groups.

Specific examples of the monomers providing the unit B include ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinyl-benzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylenedi ammonium dichloride, N,N'-bis(vinylbenzyl)triethylenediammonium dichloride, and N,N,N',N'-tetrabutyl-N,N'-bis (vinylbenzyl)ethylenediammonium dichloride. From the standpoint of hydrophobic properties and resistance to alkali, divinylbenzene and trivinylcyclohexane are particularly preferred.

Specific examples of the anion exchange polymer are shown below, but the present invention is not to be construed as being limited thereto.

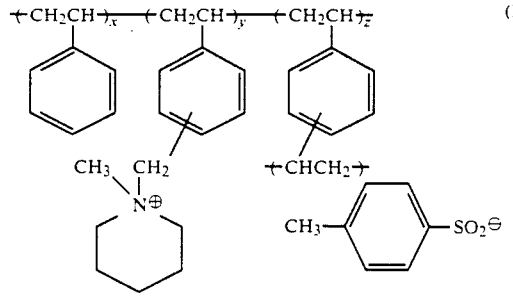

(I)

x/y/z = 47.5/47.5/5

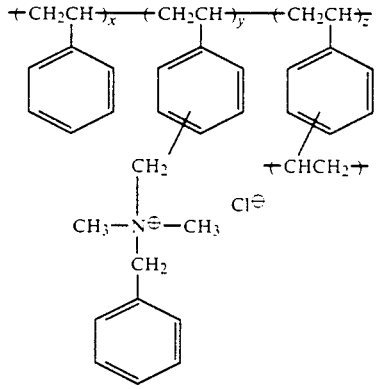

(II)

x/y/z = 45/45/10

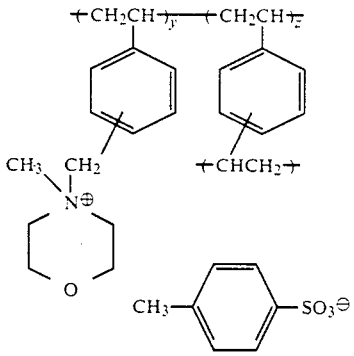

(III)

y/z = 95/5

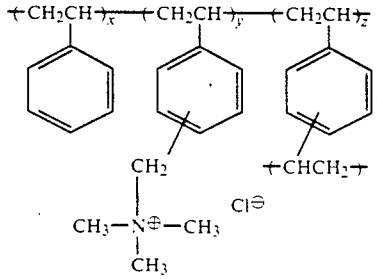

(IV)

x/y/z = 45/45/10

-continued (V)

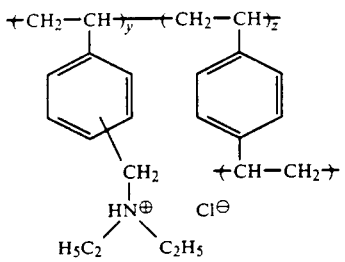

y/z = 80/20

(VI)

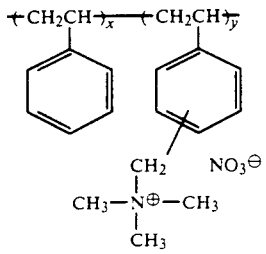

x/y = 50/50

(VII)

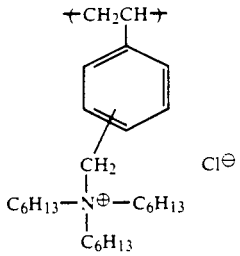

The above-described mordant is added in an amount of generally at least 0.1, preferably from 0.3 to 100, more preferably from 0.5 to 30, expressed in terms of cation site units, per mol of the total dye in the light-sensitive material.

The mordant may be incorporated into a light-sensitive layer or a light-insensitive layer, but is preferably in a light-insensitive layer provided between a light-sensitive layer and a support. It is particularly preferred for ensuring excellent rapid processing to incorporate the mordant into a subbing layer.

In addition to the above-recited mordants, useful mordants are polymers containing a residue formed by the reaction between a ketone and an aminoguanidine derivative described in JP-A-47-13935, JP-B-49-15820, and U.S. Pat. Nos. 2,882,156 and 3,740,228. Specific examples of these polymers are shown below, but the present invention is not to be construed as being limited thereto.

(VIII)

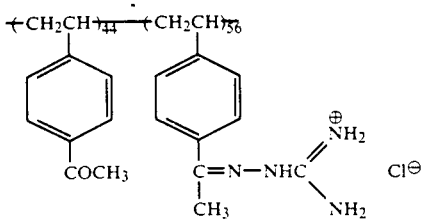

-continued (IX)

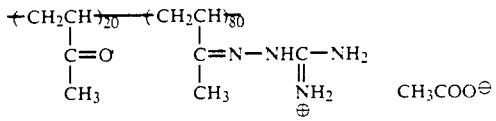

(X)

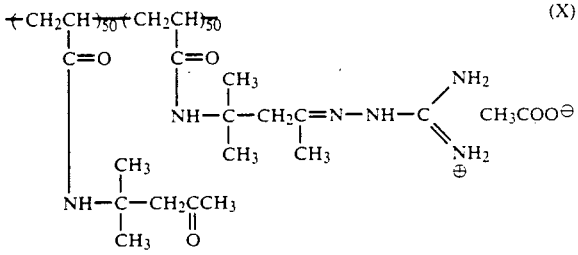

The following polymers are also useful as mordants.

(XI)

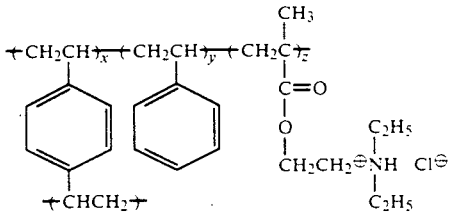

x/y/z = 15/5/80

(XII)

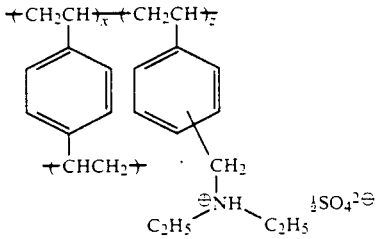

x/z = 25/75

(XIII)

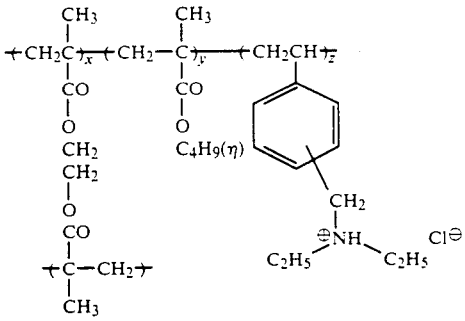

x/y/z = 30/35/35

(XIV)

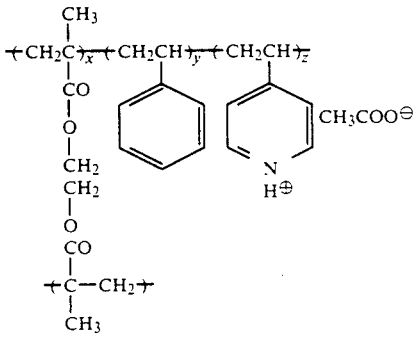

x/y/z = 40/10/50

-continued
(XV)
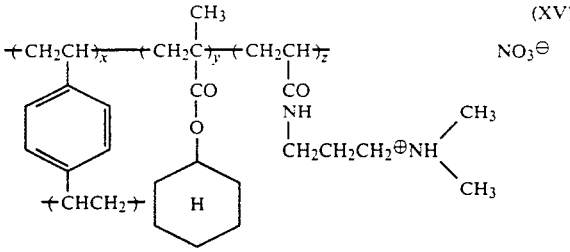
x/y/z = 25/15/60
(XVI)
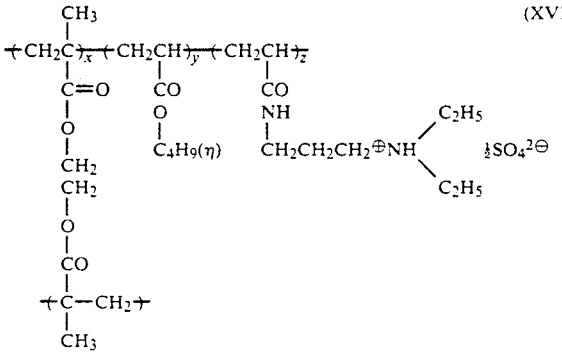
x/y/z = 25/10/65
(XVII)
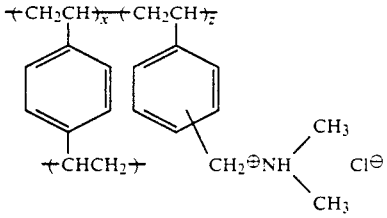
x/z = 20/80
(XVIII)
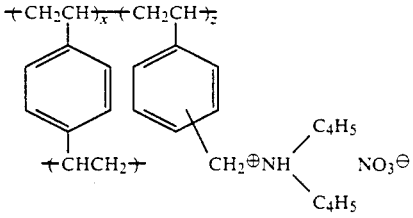
x/z = 30/70
(XIX)
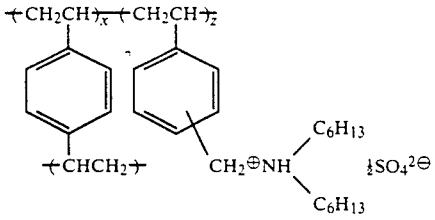
x/z = 30/70
(XX)
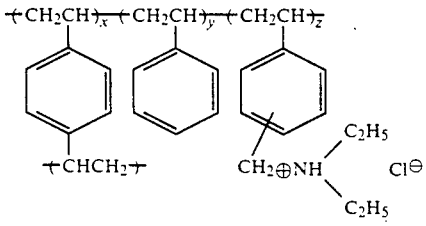
x/y/z = 15/30/55
-continued
(XXI)
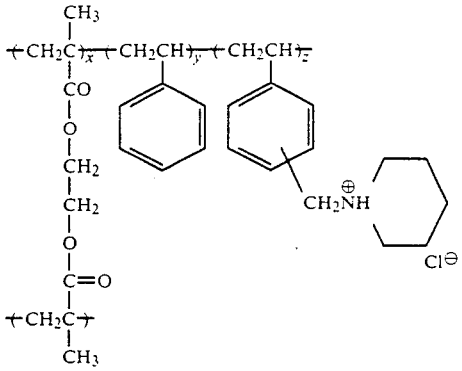
x/y/z = 40/10/50
(XXII)
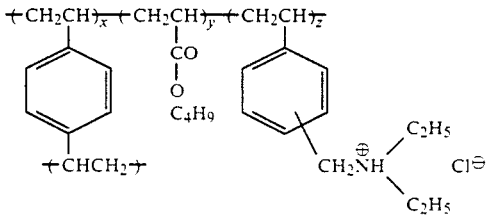
x/y/z = 50/10/40
(XXIII)
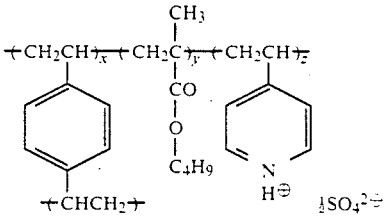
x/y/z = 20/10/70
(XXIV)
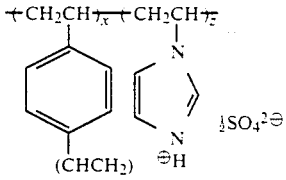
x/z = 50/50
(XXV)
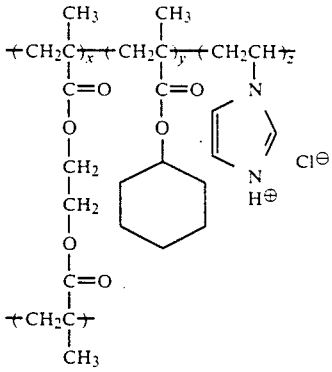
x/y/z = 25/25/50
(XXVI)
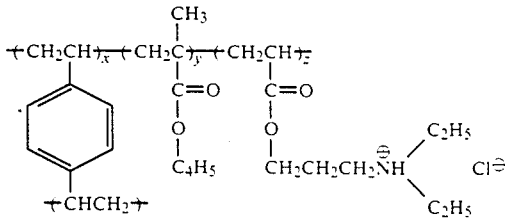

-continued x/y/z = 15/15/70

(XXVII)

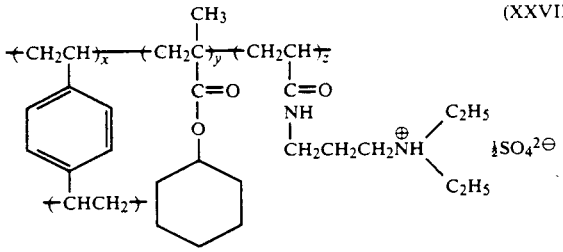

x/y/z = 35/5/60

(XXVIII)

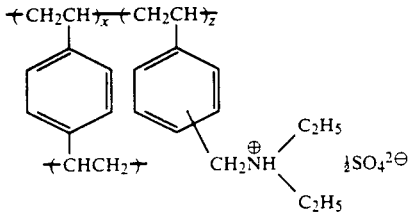

x/z = 50/50

(XXIX)

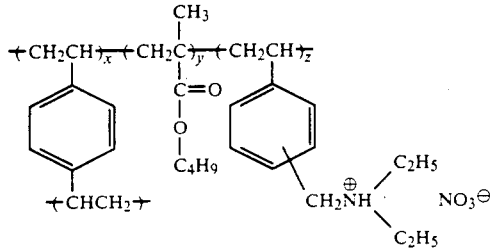

x/y/z = 45/5/50

(XXX)

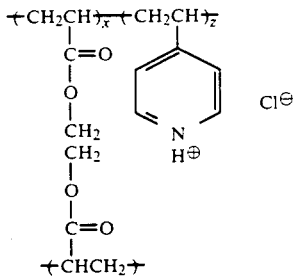

x/z = 15/85

(XXXI)

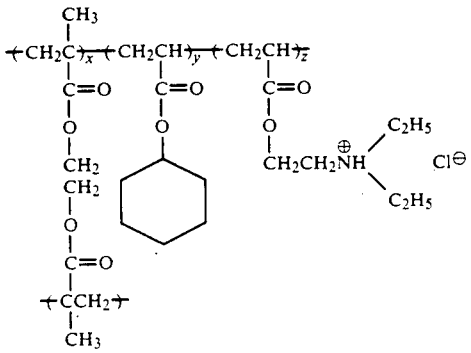

x/y/z = 20 10/70

-continued (XXXII)

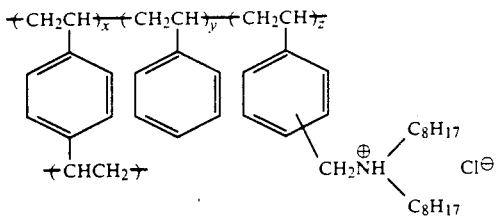

x/y/z = 17.5/2.5/80

An amount of the above anion exchange polymer added as a mordant is generally from 5 to 2,000 mg/m$^2$, preferably from 5 to 500 mg/m$^2$, and more preferably from 5 to 300 mg/m$^2$, per the light-sensitive material.

The above anion exchange polymer may be incorporated into any layer in the light-sensitive material. Preferably, the anion exchange polymer is incorporated into a lowermost layer or a subbing layer, and particularly preferably the anion exchange polymer is incorporated into the subbing layer. Further, it is preferred that the subbing layer contains nonionic surface active agents.

In the present invention, it is preferred to use the above-described anion exchange polymer in a subbing layer in combination with a nonionic surface active agent, which serves to maintain the surface conditions of the subbing layer. Compounds known as nonionic surface active agents can be used. Specific examples of preferred nonionic surface active agents which can be used in the present invention are shown below, but the present invention is not to be construed as being limited thereto.

III-1 $C_{11}H_{23}COO(CH_2CH_2O)_8H$

III-2 $C_{15}H_{31}COO(CH_2CH_2O)_{15}H$

III-3 $C_{17}H_{33}COO(CH_2CH_2O)_5(CH_2-CH(OH)-CH_2)_3(CH_2CH_2O)_5H$

III-4 $C_8H_{17}O(CH_2CH_2O)_7H$

III-5 $C_{12}H_{25}O(CH_2CH_2O)_{10}H$

III-6 $C_{16}H_{33}O(CH_2CH_2O)_{12}H$

III-7 $C_{18}H_{35}O(CH_2CH(OH)CH_2O)_2(CH_2CH_2O)_{10}H$

III-8 $C_{22}H_{45}O(CH_2CH_2O)_{25}H$

III-9

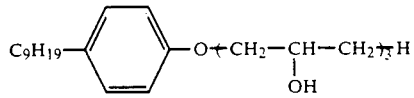

III-10

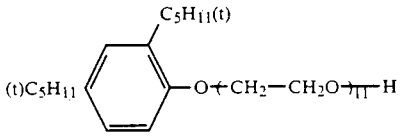

III-11

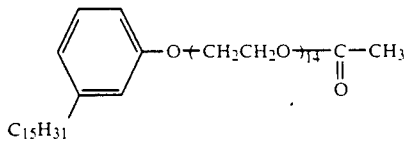

-continued

III-12

$C_{16}H_{33}O(CH_2CH_2O)_4(CH_2CH(OH)CH_2)_2(CH_2CH_2O)_4H$

III-13

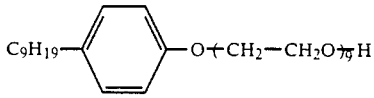

III-14

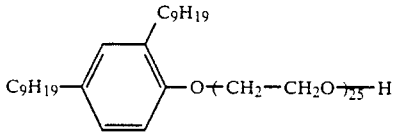

III-15

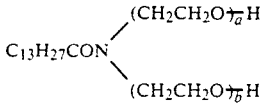

a + b = 15

III-16

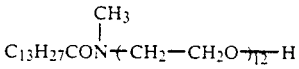

III-17

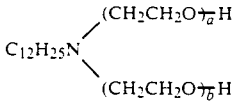

a + b = 20

III-18

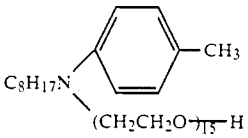

III-19

$C_{12}H_{25}S(CH_2CH_2O)_{16}H$

III-20

$C_{12}H_{25}O(CH(CH_3)CH_2O)_3(CH_2CH_2O)_{15}H$

III-21

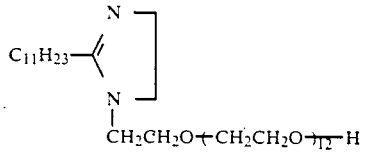

III-22

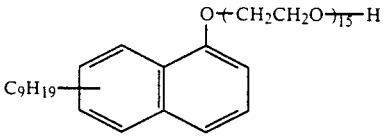

III-23

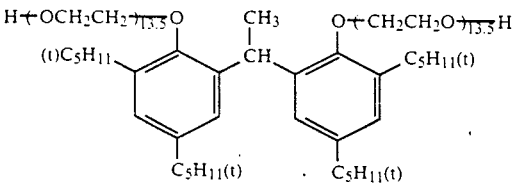

-continued

III-24

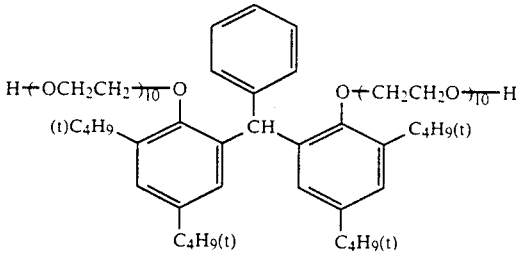

III-25

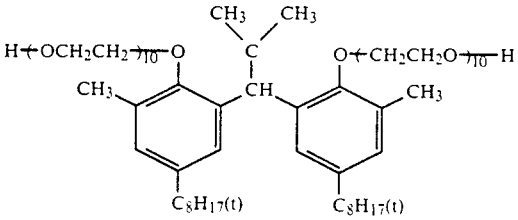

Of these nonionic surface active agents, those represented by formulae (A) and (B) are especially effective to improve surface conditions.

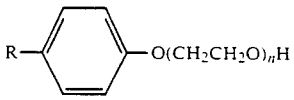

(A)

$R-O(CH_2CH_2O)_nH$ (B)

wherein R represents an alkyl group; and n represents an integer of from 5 to 50, preferably from 7 to 40. The compounds of formula (A) are known to improve adhesion, as disclosed in JP-A-62-231253. Specific examples of the compounds of formulae (A) and (B) are shown below, but the present invention is not to be construed as being limited thereto.

(III-26)

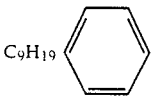

$O(CH_2CH_2O)_nH$ n = 8.5

(III-27)

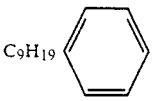

$O(CH_2CH_2O)_nH$ n = 15

(III-28)

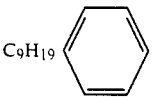

$O(CH_2CH_2O)_nH$ n = 20

(III-29)

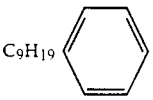

$O(CH_2CH_2O)_nH$ n = 30

(III-30)

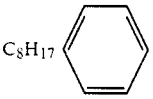

$O(CH_2CH_2O)_nH$ n = 10

$C_{12}H_{25}O(CH_2CH_2O)_nH$ n = 10 (III-31)

$C_{12}H_{25}O(CH_2CH_2O)_nH$ n = 15 (III-32)

$C_8H_{17}O(CH_2CH_2O)_nH$ n = 10 (III-33)

-continued $C_8H_{17}O(CH_2CH_2O)_nH$ n = 18 (III-34)

A coating composition for a subbing layer usually contains from 0.05 to 10 g, preferably from 0.05 to 1 g, of the nonionic surface active agent per liter.

The nonionic surface active agent is coated in an amount usually of from 0.1 to 50 mg/m$^2$, preferably from 0.5 to 20 mg/m$^2$, of the subbing layer.

The light-sensitive material of the present invention contains a dye having an absorption maximum in the visible light region. It is preferable to incorporate 80% or more of the total dye into a layer nearer to a support than a light-sensitive layer, particularly preferably the layer containing the mordant. It is particularly preferred for rapid processing to incorporate the dye into a subbing layer.

The dye which can be used in the present invention includes oxonol dyes having a pyrazolone nucleus or a barbituric acid nucleus as described, e.g., in U.S. Pat. Nos. 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233 and JP-A-59-111640, JP-B-39-22069 and JP-B-43-13168, and U.S. Pat. Nos. 3,247,127, 3,469,985, and 4,078,933; other oxonol dyes described in U.S. Pat. Nos. 2,533,472 and 3,379,533 and British Patent 1,278,621; azo dyes as described in British Patents 575,691, 680,631, 599,623, 786,907, 907,125, and 1,045,609, U.S. Pat. No. 4,255,326, and JP-A-59-211043; azomethine dyes as described in JP-A-50-100116 and JP-A-54-118247 and British Patents 2,014,598 and 750,031; anthraquinone dyes as described in U.S. Pat. No. 2,865,752; allylidene dyes as described in U.S. Pat. Nos. 2,538,009, 2,688,541 and 2,538,008, British Patents 584,609 and 1,210,252, JP-A-50-40625, JP-A-51-3623, JP-A-51-10927 and JP-A-54-118247, and JP-B-48-3286 and JP-B-59-37303; styryl dyes as described in JP-B-28-3082, JP-B-44-16594, and JP-B-59-28898; triarylmethane dyes as described in British Patents 446,583 and 1,335,422 and JP-A-59-228250; merocyanine dyes as described in British Patents 1,075,653, 1,153,341, 1,284,730, 1,475,228 and 1,542,807; and cyanine dyes as described in U.S. Pat. Nos. 2,843,486 and 3,294,539.

Typical examples of these dyes are shown below, but the present invention is not to be construed as being limited thereto.

D-1

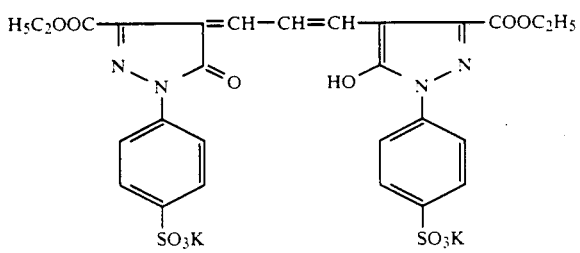

D-2

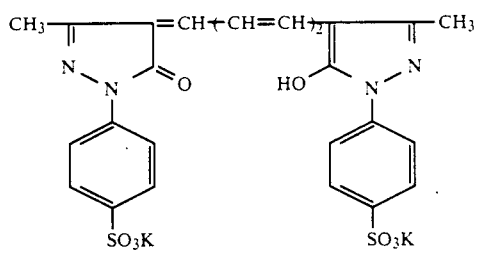

D-3

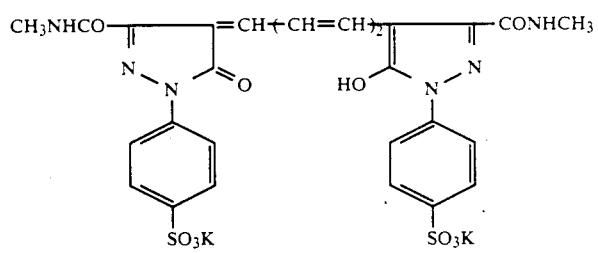

D-4

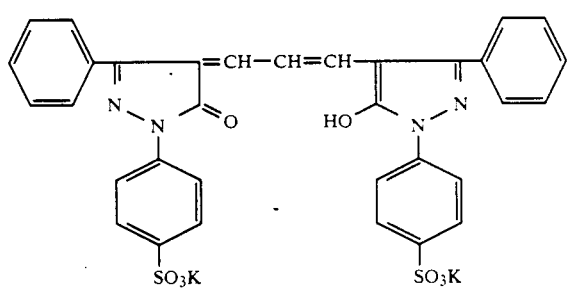

-continued
D-5
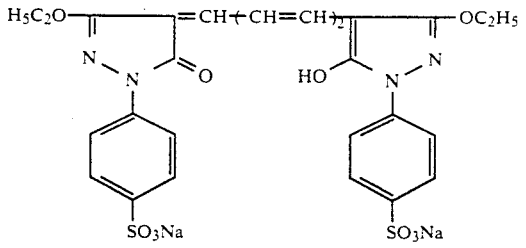
D-6
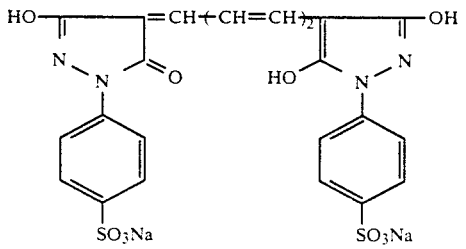
D-7
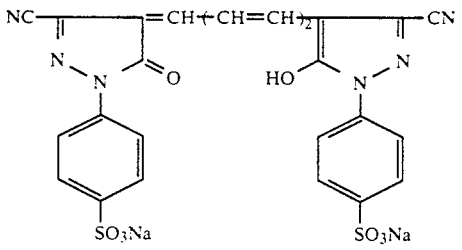
D-8
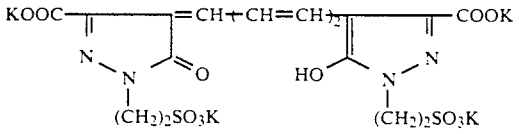
D-9
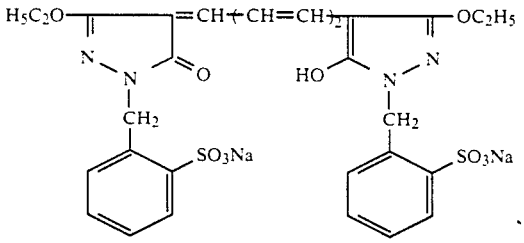
D-10
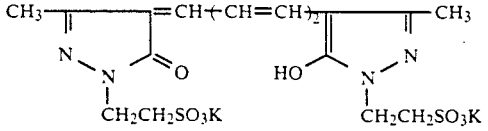
D-11
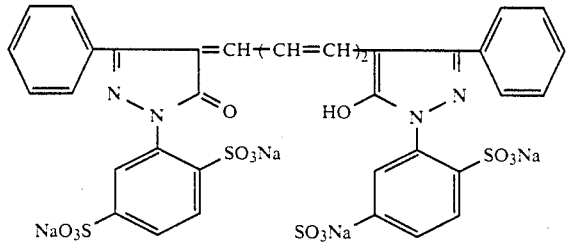

-continued
D-12
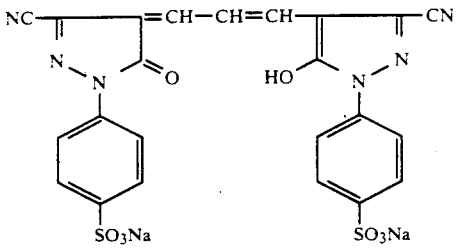
D-13
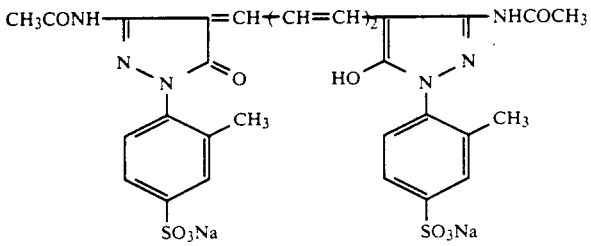
D-14
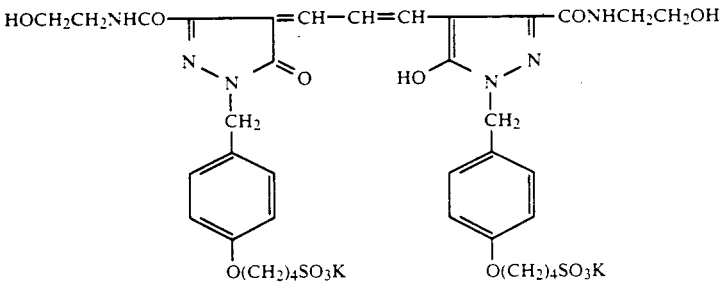
D-15
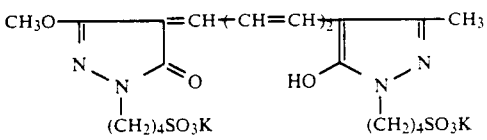
D-16
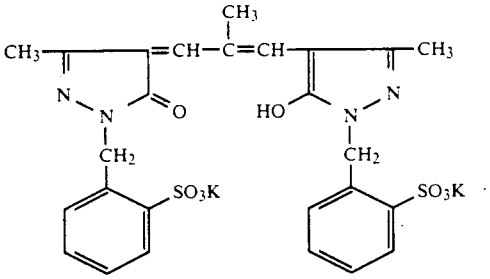
D-17
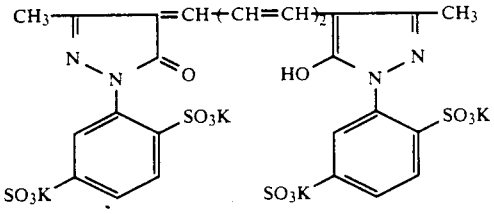
D-18
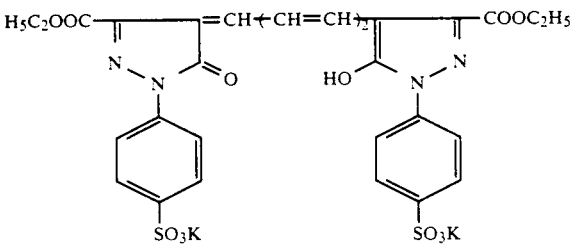

-continued
D-19
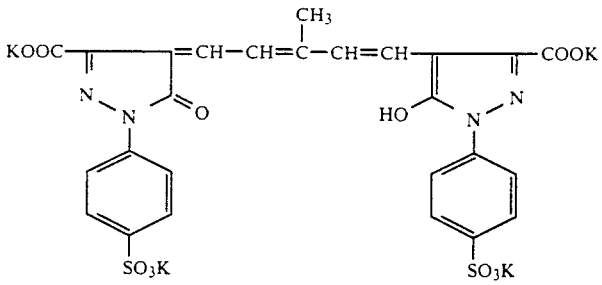
D-20
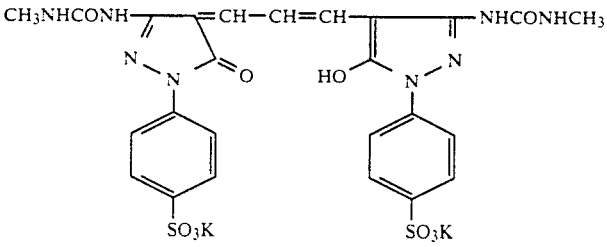
D-21
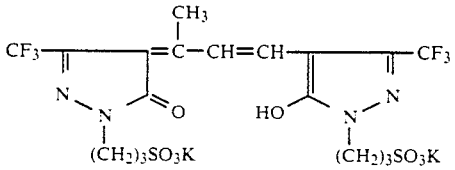
D-22
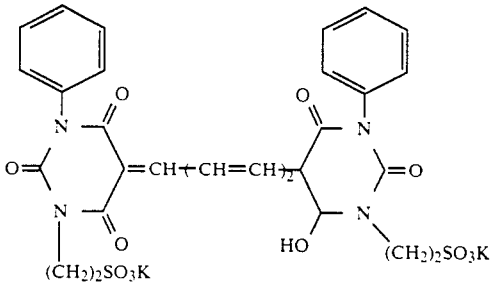
D-23
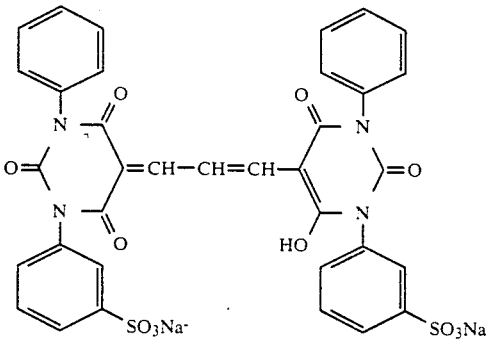
D-24
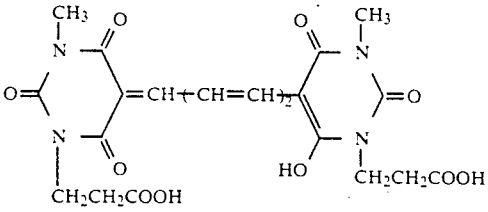

-continued
D-25
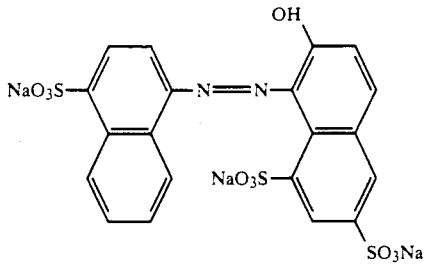
D-26
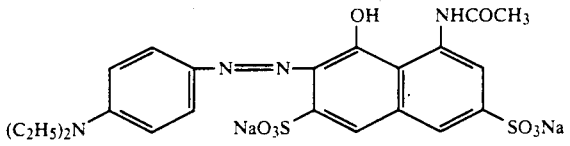
D-27
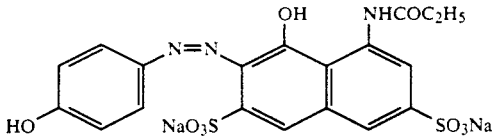
D-28
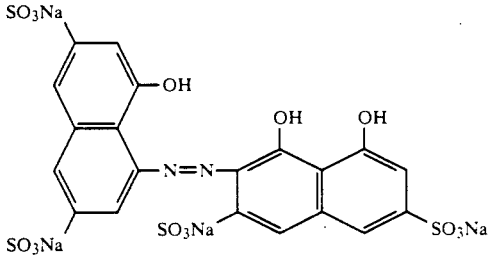
D-29
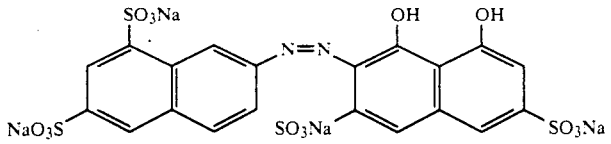
D-30
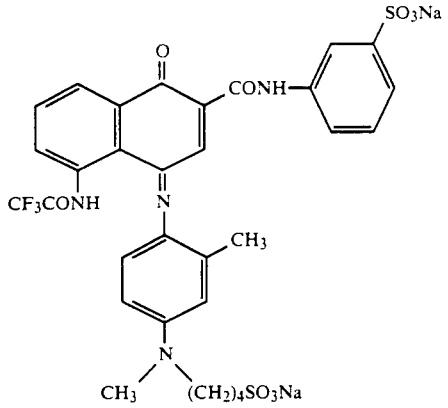
D-31
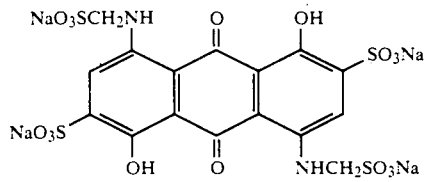

-continued
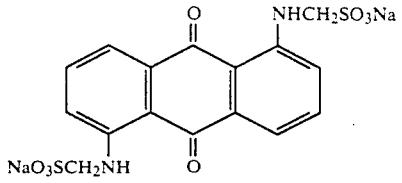
D-32
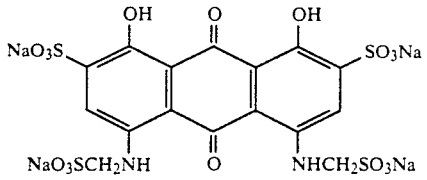
D-33
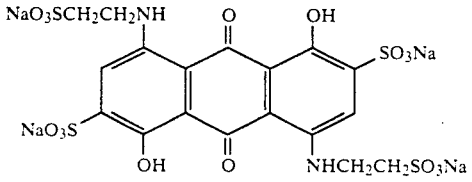
D-34
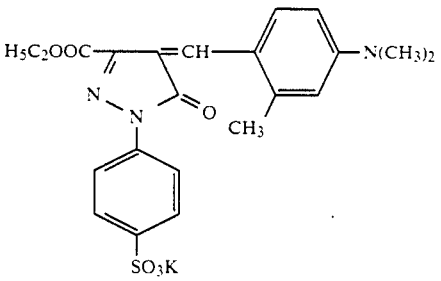
D-35
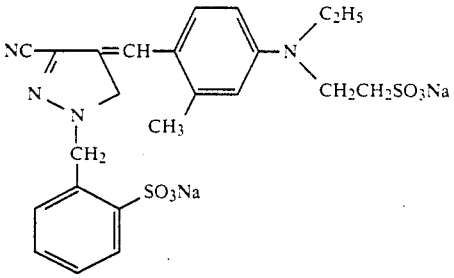
D-36
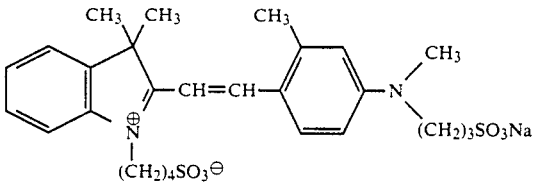
D-37
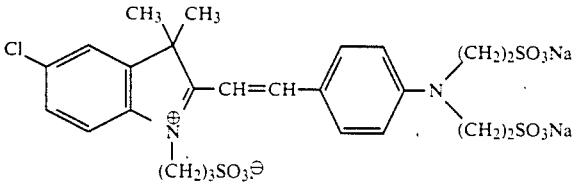
D-38

-continued
D-39
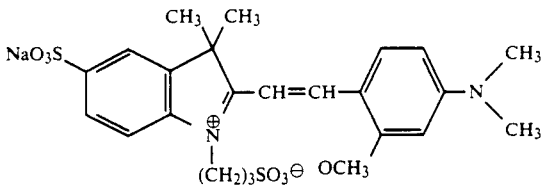
D-40
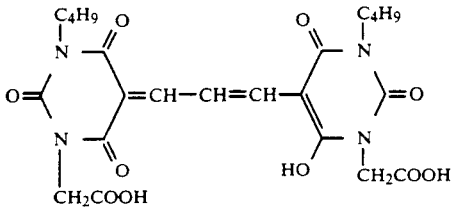
D-41
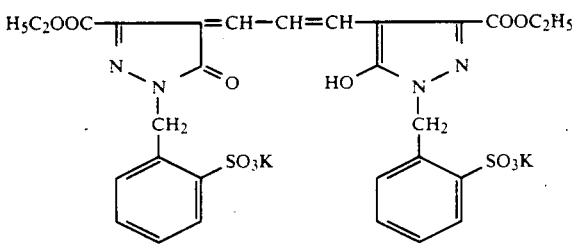
D-42
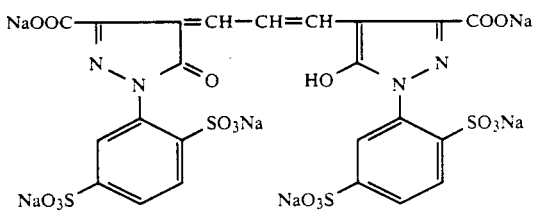
D-43
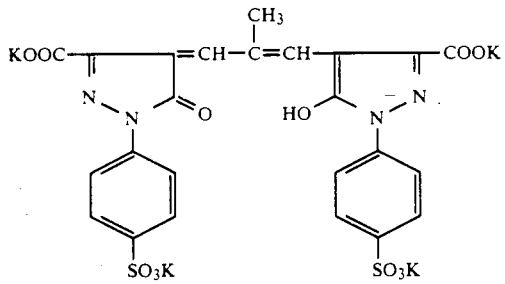
D-44
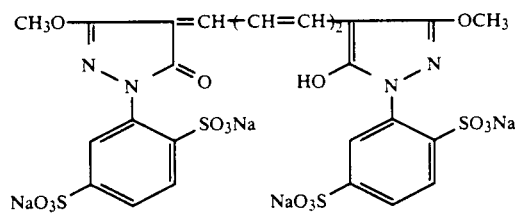
D-45
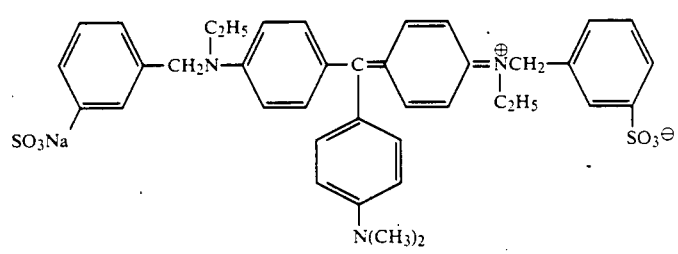

-continued
D-46
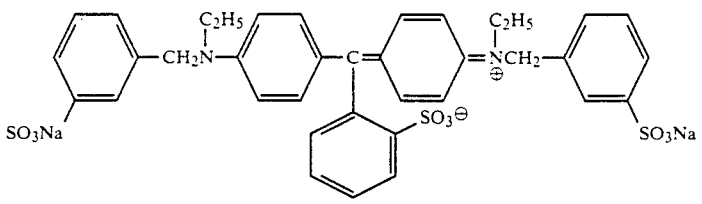
D-47
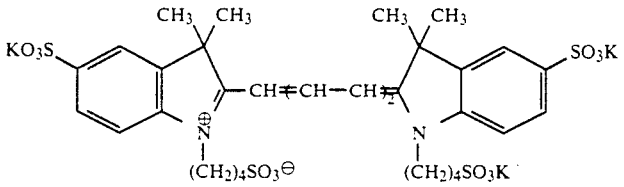
D-48
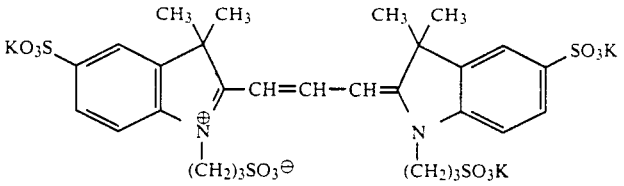
D-49
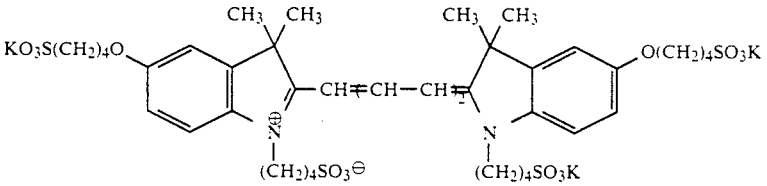
D-50
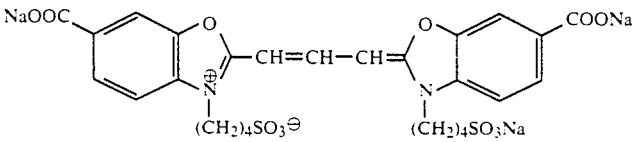
D-51
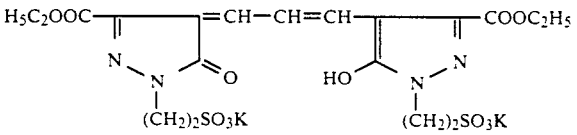
D-52
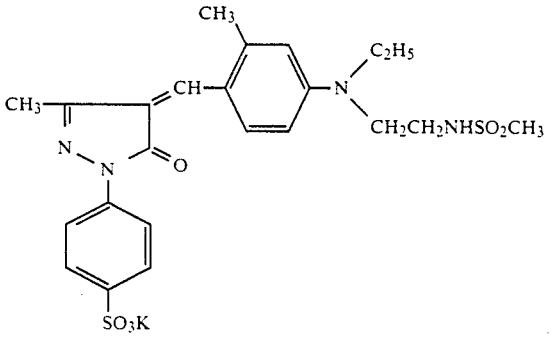

-continued
D-53
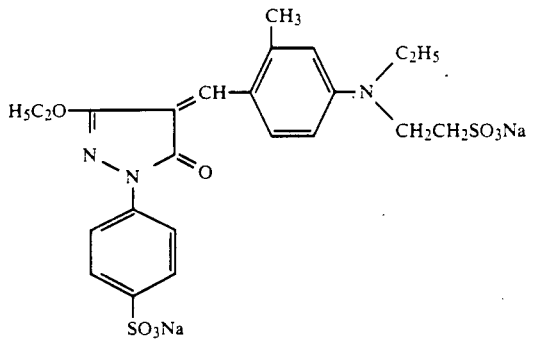
D-54
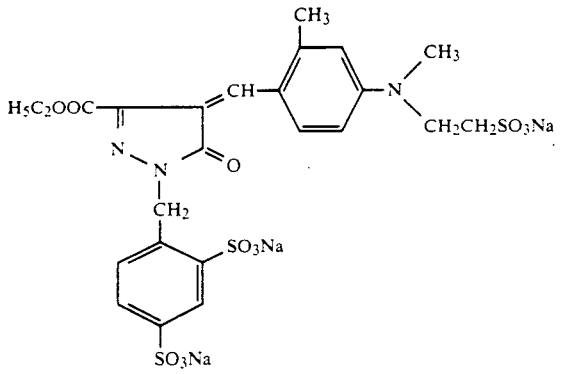
D-55
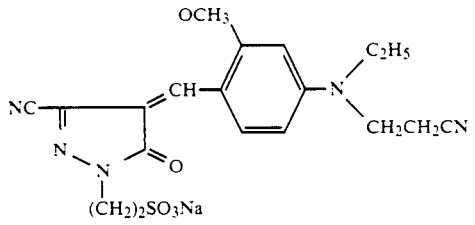
D-56
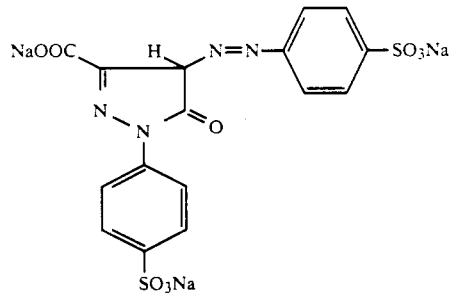
D-57
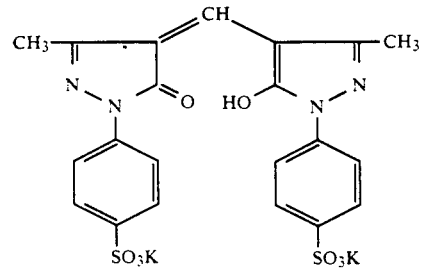

-continued
D-58
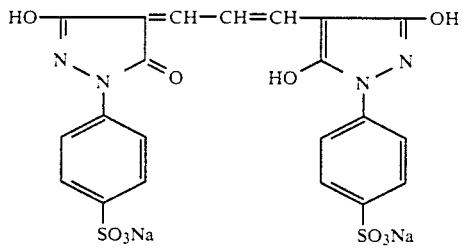
D-59
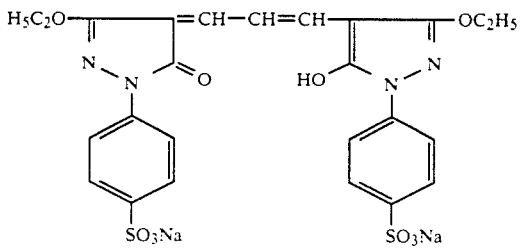
D-60
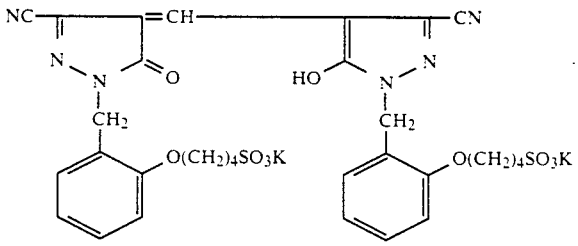
D-61
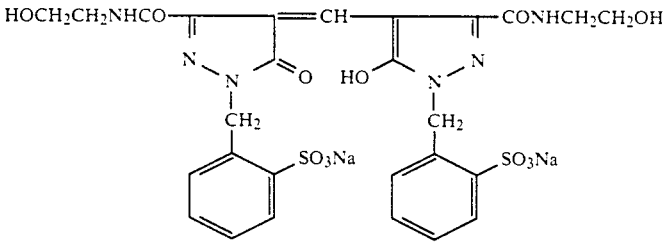
D-62
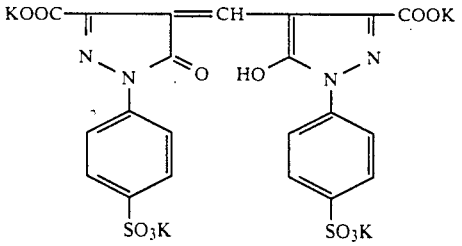
D-63
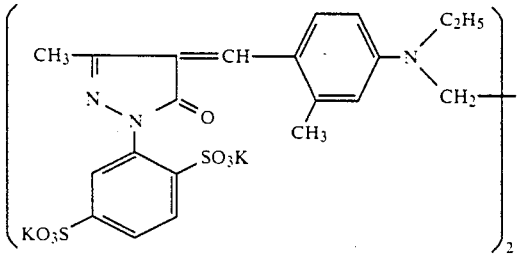

-continued
D-64
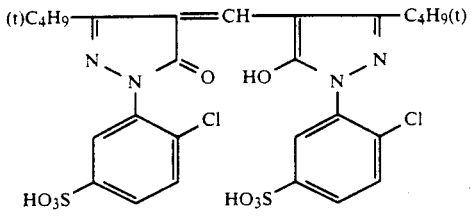
D-65
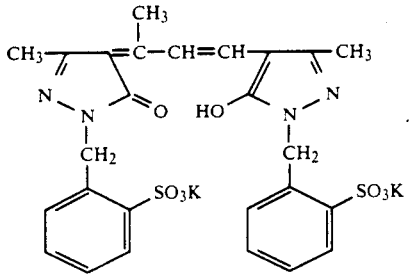
D-66
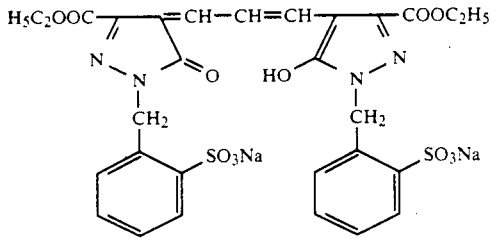
D-67
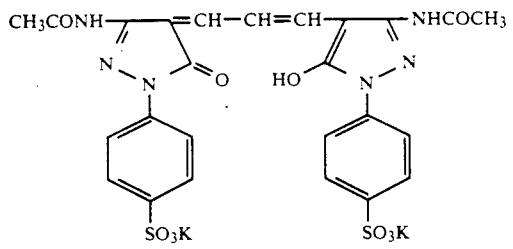
D-68
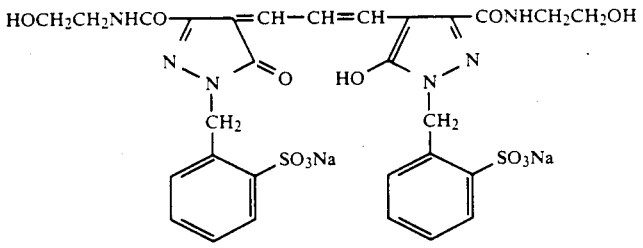
D-69
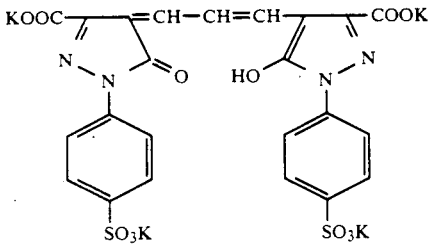

-continued

D-70

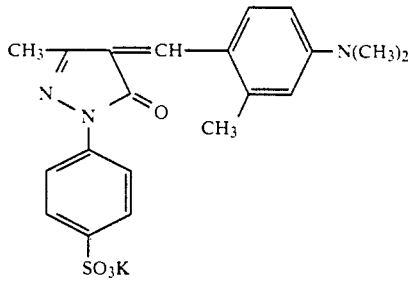

D-71

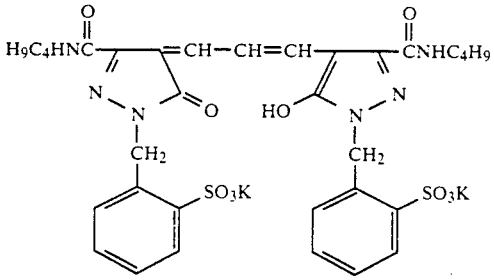

Though an amount of the dyes which can be used in the present invention is varied according to desired effects, the amount of the dyes is preferably from 1 to 2,000 mg/m$^2$ and more preferably from 5 to 400 mg/m$^2$.

The subbing layer may be a single coating or a double-layered coating. A double-layered subbing layer can be formed by coating a first layer having good adhesion to a support and then coating a hydrophilic resin layer on the first layer as described in JP-A-52-49019, JP-A-52-42114, and JP-A-52-104913. A single subbing layer contains a resin containing both a hydrophobic group and a hydrophilic group as described in JP-B-47-24270 and JP-A-51-30274. The present invention includes both, but the double-layered subbing layer gives better results.

Prior to coating the subbing layer, it is effective to subject the support to a known surface treatment, such as chemical treatment, mechanical treatment, corona discharge treatment flame treatment, ultraviolet treatment, high frequency treatment, glow discharge treatment, active plasma treatment, laser treatment, mixed acid treatment, ozone oxidation, and the like.

Use of a betaine surface active agent (e.g., $C_{11}H_{23}CONHCH_2CH_2CHN^{\oplus}(CH_3)_2COO^{\ominus}$) in the subbing layer in combination with the above-described nonionic surface active agent brings about further improved surface conditions.

The technique of JP-A-60-26944, in which water-soluble methyl cellulose is incorporated into a subbing layer, is highly beneficial for the present invention. The recommended amount of the methyl cellulose to be added is generally from about 1 to 99% by weight, preferably from 2 to 50% by weight, more preferably from 3 to 30% by weight, based on the binder. Excellent effects can be produced by using a water-soluble methyl cellulose having a degree of substitution of from 0 to 2.5, preferably from 0.5 to 2.5, more preferably from 1.0 to 2.5. The degree of polymerization of methyl cellulose can be selected appropriately in relation to the viscosity, taking the coating technique into consideration.

The light-sensitive materials according to the present invention can be processed using any of the methods and processing solutions known for black-and-white photographic processing as described, e.g., in *Research Disclosure*, No. 176, 28–30 (RD 17643). The processing temperature is usually selected in a range of from 18° C. to 50° C. Rapid processing by the use of an automatic developing machine, which is carried out at a temperature of from 30° to 45° C., is particularly preferable in the present invention. The dry-to-dry processing time preferably ranges from 30 to 120 seconds, and particularly preferably from 30 to 90 seconds, in case of medical light-sensitive materials.

The developer and the light-sensitive material can contain known developing agents, such as dihydroxybenzenes (e.g., hydroquinone), 3-pyrazolidones (e.g., 1-phenyl-3-pyrazolidone), and aminophenols (e.g., N-methyl-p-aminophenol), either individually or in combinations thereof. Further, the developer generally contains known additives, such as preservatives, alkali agents, pH buffering agents, and antifoggants. If desired, the developer may furthermore contain dissolution aids, toning agents, development accelerators (e.g., quaternary salts, hydrazines, benzyl alcohol), surface active agents, defoaming agents, water softeners, hardening agents (e.g., glutaraldehyde), viscosity imparting agents, and so on.

In a special processing system, a developing agent may be incorporated into the light-sensitive material, for example, an emulsion layer thereof, and the material is processed in an alkaline aqueous solution to effect development. Hydrophobic development agents can be incorporated into an emulsion layer by various techniques described in *Research Disclosure*, No. 169 (RD 16928), U.S. Pat. No. 2,739,890, British Patent 813,253, and West German Patent 1,547,763. Such a processing system may be combined with a silver salt stabilization step using thiocyanates.

A fixer to be used may have any commonly employed composition. A fixing agent includes thiosulfates, thiocyanates, and organic sulfur compounds known to have fixing effects. The fixer may contain a water-soluble aluminum salt as a hardening agent. The fixing time is usually not more than 15 seconds, preferably not more than 10 seconds, more preferably not more than 7 seconds.

Silver halides which can be used in the present invention include silver chloride, silver chlorobromide, silver bromide, silver iodobromide, and silver chloroiodobromide, with silver bromide and silver iodobromide being preferred from the viewpoint of sensitivity. Particularly preferred are those having an iodine content of up to 3.5 mol %. In case of using silver iodobromide, grains whose iodine content is higher in the interior of the grain are particularly preferred.

The light-sensitive materials of the present invention may contain a compound capable of releasing a development inhibitor during development as described in JP-A-61-230135 and JP-A-63-25653.

In case of medical light-sensitive materials, the silver coverage on one side of the support is from 1.0 to 6.0 $g/m^2$, preferably from 1.0 to 3.0 $g/m^2$.

The silver halide grains preferably have a mean sphere-equivalent diameter of generally not smaller than 0.3 μm, more preferably from 0.3 to 2.0 μm. Size distribution may be either narrow or broad, but a monodispersed emulsion or a mixture of monodispersed emulsion is preferred.

The silver halide grains may have a regular crystal form, such as a cubic form and an octahedral form; or an irregular crystal form, such as a spherical form, a plate form, and a pebble like form; or a composite form thereof. The emulsion may be composed of variously different grains in crystal form.

The photographic emulsions can be prepared by processed described, e.g., in P. Glafkides, *Chemie et Physique Photographique* (Paul Montel, 1967), G. F. Duffin, *Photographic Emulsion Chemistry* (Focal Press, 1966), and V. L. Zelikman, et al., *Making and Coating Photographic Emulsion* (Focal Press, 1964). In some detail, the emulsions can be prepared by any of an acid process, a neutral process or an ammonia process. The reaction between a soluble silver salt and a soluble halogen salt can be carried out by any of a single jet process, a double jet process, and a combination thereof.

Tabular silver halide grains are particularly useful in the present invention. Tabular silver halide grains can be prepared by an appropriate combination of conventional techniques. For example, tabular grain emulsions are described in detail in Cugnac and Chateau, *Science et Industrie Photography*, "Evolution of the Morphology of Silver Bromide Crystals during Physical Ripening", Vol. 33, No. 2, pp. 121–125 (1962), G. F. Duffin, *Photographic Emulsion Chemistry*, pp. 66–72 (Focal Press, New York, 1966), and A. P. H. Trivelli and W. F. Smith, *Photographic Journal*, Vol. 80, 285 (1940). The tabular grains can be prepared easily by referring to the processes disclosed in JP-A-58-127921, JP-A-58-113927, and JP-A-58-113928 and U.S. Pat. No. 4,439,520.

Preferred tabular grain emulsions for use in the present invention have an average aspect ratio of generally 3 or more, particularly from 4 to 8, the "average aspect ratio" being defined in U.S. Pat. No. 4,439,520, Cl. 12.

The tabular grain emulsion can also be obtained by a process of forming seed crystals containing at least 40% by weight of tabular grains in an atmosphere having a relatively low pBr value of 1.3 or less and then allowing the seed crystals to grow by simultaneously adding a silver salt solution and a halogen salt solution to the system while maintaining the pBr value at substantially the same level as used above. During the grain growth, it is desirable to add the silver salt and halogen salt solutions under control so as not to form new crystal nuclei.

The size of tabular silver halide grains can be adjusted by control of the temperature, selection of the kind and amount of the solvent, and control of rate of addition of a silver salt or a halogen salt during grain growth.

The individual silver halide grains may have a homogeneous structure throughout the grain or may have a layered structure having a halogen composition varied between the internal core and the outer shell. Conversion type grains as described in British Patent 635,841 and U.S. Pat. No. 3,622,318 can also be used. Silver halide grains having fused thereto other silver halides differing in halogen composition or other compounds than silver halides such as silver thiocyanate and silver oxide, through epitaxial growth may also be employed. The grains may be of either a surface latent image type or of an internal latent image type, but those grains which form latent image specks centered at special sites of the surface (e.g., vertices) as described in Japanese Patent Application No. 62-141112 are particularly preferred.

During the grain formation, a silver halide solvent, e.g., ammonia, thioether compounds, thiazolidine-2-thione, and tetra-substituted thiourea may be present in the system.

The photographic layers constituting the light-sensitive materials of the present invention may contain an alkyl acrylate latex as described in U.S. Pat. Nos. 3,411,911 and 3,411,912 and JP-B-45-5331.

The silver halide emulsion may be used without chemical sensitization, that is, as a primitive emulsion, but is usually subjected to chemical sensitization. Chemical sensitization can be carried out by known techniques, as described in the above-cited publications of Glafkides or Zelikman et al. and H. Frieser (ed.), *Die Grundlagen der Photographischen Prozesse mit Silberhalogeniden* (Akademische Verlagsgesellschaft, 1968). In some detail, chemical sensitization can be effected by sulfur sensitization using active gelatin or a sulfur-containing compound capable of reacting with silver, e.g., thiosulfates, thioureas, thiazoles, and rhodanines (specific examples of the sulfur sensitizers are described in U.S. Pat. Nos. 1,574,944, 2,410,689, 2,278,947, 2,728,668 and 3,656,955); reduction sensitization using a reducing substance, e.g., stannous salts, amines, hydrazine derivatives, formamidinesulfines, and silane compounds; noble metal sensitization using a noble metal compound, e.g., gold complex salts as well as complex salts of group VIII metals, e.g., platinum, iridium, palladium; and combinations thereof.

For the purpose of preventing fog during preparation, preservation or photographic processing of the light-sensitive materials or stabilizing photographic performance properties, the photographic emulsion layers can contain various compounds, including azoles, such as benzothiazolium salts, nitroimidazoles, nitrobenzimidazoles, chlorobenzimidazoles, bromobenzimidazoles, nitroindazoles, triazoles, benzotriazoles, benzimidazoles (especially nitro- or halogen-substituted), and aminotriazoles; heterocyclic mercapto compounds, e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines, and these heterocyclic mercapto compounds containing a water-soluble group (e.g., a carboxyl group, a sulfo group); thioketo compounds, e.g., oxazolinethione;

azaindenes, e.g., triazaindenes, tetraazaindenes (especially 4-hydroxy-substituted (1,3,3a,7)tetraazaindenes), and pentaazaindenes; benzenethiosulfonic acid, benzenesulfinic acids, benzenesulfonic acid amide; and many other compounds known as antifoggant or stabilizers.

Details of these antifoggants or stabilizers and usage thereof are described, e.g., in U.S. Pat. Nos. 3,954,474, 3,982,947 and 4,021,248, and JP-B-52-28660. Particularly preferred antifoggants or stabilizers are nitron and its derivatives described in JP-A-60-76743 and JP-A-60-87322; mercapto compounds described in JP-A-60-80839; heterocyclic compounds described in JP-A-57-164735; and silver complex salts of heterocyclic compounds (e.g., 1-phenyl-5-mercaptotetrazole silver complex).

A combination of tabular grains and a hydroquinone derivative as disclosed in Japanese Patent Application No. 62-228030 is preferably used in the present invention.

The photographic emulsions to be used in the present invention are preferably sensitized with sensitizing dyes to relatively long wavelength blue light, green light, red light or infrared light. Sensitizing dyes to be used for spectral sensitization include cyanine dyes, merocyanine dyes, complex cyanine dyes, complex merocyanine dyes, holopolar cyanine dyes, hemicyanine dyes, styryl dyes, oxonol dyes, and hemioxonol dyes. Of these, cyanine dyes, merocyanine dyes and complex merocyanine dyes are particularly useful. Examples of useful sensitizing dyes are described, e.g., in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,838, 3,567,458, 3,625,698, 2,526,632, and 2,503,776, JP-A-48-76525, and Belgian Patent 691,807.

Any of basic heterocyclic nuclei generally utilized in cyanine dyes can be applied to these dyes. Such basic heterocyclic nuclei include pyrroline, oxazoline, thiazoline, pyrrole, oxazole, thiazole, selenazole, imidazole, tetrazole, and pyridine nuclei; the above-described nuclei to which an alicyclic hydrocarbon ring is fused; and the above-described nuclei to which an aromatic hydrocarbon ring is fused, e.g., indolenine, benzindolenine, indole, benzoxazole, naphthoxazole, benzothiazole, naphthothiazole, benzoselenzole, benzimidazole, and quinoline nuclei. These nuclei may have substituents on the carbon atoms thereof.

The merocyanine dyes or complex merocyanine dyes can contain a 5- or 6-membered heterocyclic nucleus having a ketomethylene structure, e.g., pyrazolin-5-one, thiohydantoin, 2-thiooxazolidine-2,4-dione, thiazolidine-2,4-dione, rhodanine, and thiobarbituric acid nuclei.

These sensitizing dyes can be added at any stage during the preparation of a photographic emulsion (e.g., grain formation stage, physical ripening stage, or chemical ripening stage) or at any stage after the preparation but immediately before coating.

In case of performing color sensitization, the sensitizing effects can be increased by using, in combination, an adsorbing substance which competes with the sensitizing dye in adsorption (e.g, sensitizing dyes different from those used for color sensitization, the above-recited stabilizers or antifoggants) in an amount of from $10^{-3}$ to $10^{-1}$ mol % based on the sensitizing dyes.

The photographic emulsion layers or other hydrophilic colloidal layers of the light-sensitive material may container various surface active agents as a coating aid or an antistatic agent or for improvement of slipping properties, improvement of emulsifying dispersibility, prevention of adhesion, improvement of photographic characteristics (e.g., acceleration of development, increase of contrast, and increase of sensitivity), and the like.

Examples of the surface active agent to be added include nonionic surface active agents, such as saponin (steroid type), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamide, silicon-polyethylene oxide adducts), glycidol derivatives (e.g., alkenylsuccinic polyglycerides, alkylphenyl polyglycerides), fatty acid esters of polyhydric alcohols, and alkyl esters of sugars; anionic surface active agents containing an acid group (e.g., carboxyl, sulfo, phospho, sulfate, and phosphate groups), such as alkylcarboxylates, alkylsulfonates, alkylbenzenesulfonates, alkylnaphthalenesulfonates, alkylsulfates, alkyl phosphates, N-acyl-N-alkyltaurines, sulfosuccinates, sulfoalkypolyoxyethylene alkylphenyl ethers, and polyoxyethylene alkylphosphates; amphoteric surface active agents, such as amino acids, aminoalkylsulfonic acids, aminoalkyl sulfates or phosphates, alkylbetaines, amine oxides; and cationic surface active agents, such as alkylamine salts, aliphatic or aromatic quaternary ammonium salts, heterocyclic quaternary ammonium salts, e.g., pyridinium, imidazolium, aliphatic or heterocyclic phosphonium or sulfonium salts, and the like. Particularly preferred are anionic surface active agents, e.g., saponin, sodium dodecylbenzenesulfonate, sodium di-2-ethylhexyl-α-sulfosuccinate, sodium p-octylphenoxyethoxyethanesulfonate, sodium dodecylsulfate, sodium triisopropylnaphthalenesulfonate, and sodium N-methyl-oleoyltaurine; cationic surface active agents, e.g., dodecyltrimethylammonium chloride, N-oleoyl-N', N',N'-trimethylammoniodiaminopropane bromide, and dodecylpyridium chloride; and nonionic surface active agent, e.g., betaines such as N-dodecyl-N,N-dimethylcarboxybetaine poly(average degree of polymerization: n=10)oxyethylene cetyl ether, poly(n=25)oxyethylene p-nonylphenyl ether, bis(1-poly(n=15)-oxyethylene-oxy-2,4-di-t-pentylphenyl)ethane).

For particular use as antistatic agents, preferred are fluorine-containing surface active agents, e.g., potassium perfluorooctanesulfonate, sodium N-propyl-N-perfluorooctanesulfonylglycine, sodium N-propyl-N-perfluorooctanesulfonylaminoethyloxypoly(n=3)oxyethylenebutanesulfonate, N-perfluorooctanesulfonyl-N',N',N'-trimethylammoniodiaminopropane chloride, and N-perfluorodecanoylaminopropyl-N',N'-dimethyl-N'-carboxybetaine; nonionic surface active agents as described in JP-A-60-80848 and JP-A-61-112144, JP-A-62-172343 and JP-A-62-173456, nitrates of alkali metals; and conductive tin oxide, zinc oxide, and vanadium pentoxide, or antimony-doped composite oxides of these oxides.

The light-sensitive materials of the present invention may contain matting agents, such as fine particles of polymethyl methacrylate homopolymer or a methyl methacrylate/methacrylic acid copolymer, organic compounds (e.g., starch), and inorganic compounds (e.g., silica, titanium dioxide, strontium barium sulfate) as described in U.S. Pat. Nos. 2,992,101, 2,701,245, 4,142,894 and 4,396,706. The particle size of the matting agent preferably ranges from 1.0 to 10 μm, more preferably from 2 to 5 μm.

The surface layer of the light-sensitive material of the present invention can contain a sliding agent (a lubricant), e.g., silicone compounds as described in U.S. Pat. Nos. 3,489,576 and 4,047,958, colloidal silica as described in JP-B-56-23139, paraffin wax, higher fatty acid esters, and starch derivatives.

The hydrophilic colloidal layers of the light-sensitive material of the present invention can contain a polyol (e.g., trimethylolpropane, pentanediol, butanediol, ethylene glycol, glycerin) as a plasticizer.

Binders or protective colloids which can be used in emulsion layers, interlayers and surface protective layers include gelatin to advantage. Other hydrophilic colloids may also be employed. Examples of the hydrophilic colloids are proteins, such as gelatin derivatives, graft polymers of gelatin and other high polymers, albumin, and casein; cellulose derivatives, e.g., hydroxyethyl cellulose, carboxymethyl cellulose, and cellulose sulfate; sugar derivatives, e.g., sodium alginate, dextran, and starch derivatives; and a variety of synthetic hydrophilic polymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, as well as copolymers containing the monomers constituting these homopolymers.

The gelatin to be used includes not only lime-processed gelatin but also acid- or enzyme-processed gelatin and hydrolysis products or enzymatic decomposition products of gelatin. In particular, gelatin containing a high molecular weight component as described in JP-A-62-87952 is preferred.

It is especially preferred to use gelatin in combination with dextran or polyacrylamide having an average molecular weight of not more than 50,000.

The photographic emulsion layers or other hydrophilic colloidal layers can contain organic or inorganic hardening agents. Examples of the hardening agents include chromates (e.g., chromium alum, chromium acetate), aldehydes (e.g., formaldehyde, glyoxal, succinaldehyde, glutaraldehyde), N-methylol compounds (e.g., dimethylolurea, methyloldimethylhydantoin), dioxane derivatives (e.g., 2,3-dihydroxydioxane), active vinyl compounds (e.g., divinylsulfone, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine, bis(vinylsulfonylmethyl) ether, N,N'-methylenebis[β-(vinylsulfonyl)propionamide], 1,3-bis(vinylsulfonylmethyl)propanol-2, bis(α-vinylsulfonylacetamido)ethane), active halogen compounds (e.g., 2,4-dichloro-6-hydroxy-s-triazine), mucohalogenic acids (e.g., mucochloric acid, mucophenoxychloric acid), N-carbamoylpyridinium salts (e.g., (1-morpholinocarbonyl-3-pyridinio)methanesulfonate), haloamidinium salts (e.g., 1-(1-chloro-1-pyridinomethylene)pyrrolidinium-2-naphthalenesulfonate), isoxazoles, dialdehyde starch, 2-chloro-6-hydroxytriazinylated gelatin, and combinations thereof.

Preferred of these compounds are active vinyl compounds described in JP-A-53-41221, JP-A-53-57257, JP-A-59-162546, and JP-A-60-80846; and active halogen compounds described in U.S. Pat. No. 3,325,287.

Typical supports to be used in the present invention include films of cellulose nitrate, cellulose acetate, polyvinyl acetal, polystyrene, polyethylene terephthalate or other polyesters, glass, paper, metal, and wood.

The present invention is now illustrated in greater detail with reference to the following specific examples and comparative examples, but the present invention is not to be construed as being limited thereto. In these examples, all parts, percents and ratios are by weight unless otherwise specified.

EXAMPLE 1

(1) Preparation of Light-Sensitive Silver Halide Emulsion

Potassium bromide, potassium iodide, and silver nitrate were added to a gelatin aqueous solution while vigorously stirring to prepare a thick plate-like silver iodobromide emulsion (mean grain size: 1 μm; average iodine content: 10 mol %). After washing according to a conventional sedimentation method, D-1 was added to the emulsion. Thereafter, the emulsion was subjected to gold-sulfur sensitization using chloroauric acid and sodium thiosulfate to obtain a light-sensitive silver iodobromide emulsion (designated as Emulsion A).

Emulsion B having thick plate-like grains (average iodine content: 6 mol %) was prepared in the same manner as for Emulsion A, except that the amount of potassium iodide and the temperature condition were controlled.

(2) Preparation of Light-Sensitive Material

A triacetyl cellulose film having a backing layer of the following composition was used as a support.

| Backing Layer | |
|---|---|
| 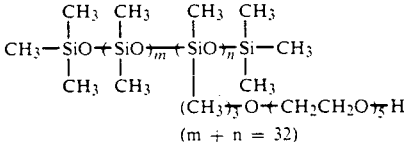 (m + n = 32) | 10 mg/m² |
| 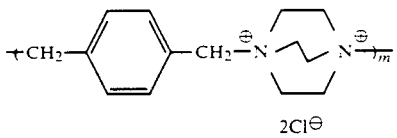 | 60 mg/m² |
| Silicon Oxide | 5 mg/m² |

The following layers were simultaneously coated on the support in the order listed to prepare Samples I-1 to I-11.

| | |
|---|---|
| Undermost Layer | |
| Binder: Gelatin-1 | 1 g/m² |
| Coating Aid: Potassium Poly-p-styrenesulfonate | 10.0 mg/m² |
| Antihalation Layer | |
| Surfactant: 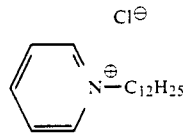 | 6 mg/m² |
| Binder: Gelatin-1 | 1 g/m² |

-continued

| | |
|---|---|
| Mordant | See Table 1 |
| Dye | See Table 1 |
| Interlayer | |
| Binder: Gelatin-1 | 0.4 g/m$^2$ |
| Coating Aid: Potassium Poly-p-styrenesulfonate | 3.3 mg/m$^2$ |
| First Emulsion Layer | |
| Emulsion B | 1.5 g of Ag/m$^2$ |
| Binder: Gelatin-2 | 2 g/m$^2$ |
| Sensitizing Dye: D-1 | 2.1 mg/g of Ag |
| Additive: $C_{18}H_{35}O(CH_2CH_2O)_{20}H$ | 5.8 mg/g of Ag |
| Coating Aid: Potassium Poly-p-styrenesulfonate | 50 mg/m$^2$ |
| Hardening Agent: 1,2-Bis(vinylacetamido)ethane | 45 mg/m$^2$ |
| Second Emulsion Layer | |
| Emulsion A | 4 g of Ag/m$^2$ |
| Dextran (average molecular weight: 160,000) | 1.4 g/m$^2$ |
| Binder: Gelatin-2 | 4.2 g/m$^2$ |
| Sensitizing Dye: D-1 | 2.1 mg/g of Ag |
| Additives: $C_{18}H_{35}O(CH_2CH_2O)_{20}H$ | 5.8 mg/g of Ag |
| Trimethylolpropane | 420 mg/m$^2$ |
| Coating Aid: Potassium Poly-p-styrenesulfonate | 100 mg/m$^2$ |

Sensitizing Dye, D-1:

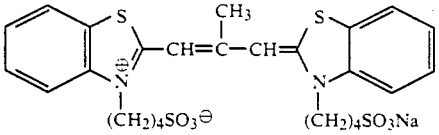

| | |
|---|---|
| Surface Protective Layer | |
| Binder: Gelatin-3 | 0.7 g/m$^2$ |
| Sliding Agents (lubricants): | 230 mg/m$^2$ |

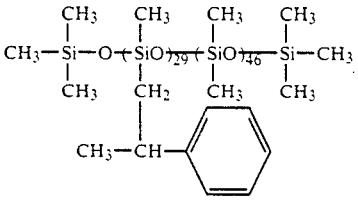

| | |
|---|---|
| $C_8F_{17}SO_2N(C_3H_7)CH_2COOK$ | 2 mg/m$^2$ |
| Coating Aid: | 10 mg/m$^2$ |

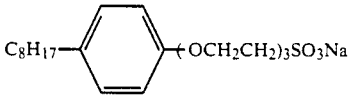

-continued

| | |
|---|---|
| Matting Agent: Polymethyl Methacrylate Fine Particles (average particle size: 3 μm) | 0.13 mg/m$^2$ |

Gelatin-1, Gelatin-2, and Gelatin-3 used in the above layers contained 15.9 wt %, 4.1 wt %, and 13.2 wt % of a high molecular weight component, respectively, as measured by the method described in JP-A-62-87952.

(3) Sensitometry

Each of the resulting samples was preserved at 30° C. and 65% RH for 14 days, and then evaluated for photographic sensitivity, sharpness (MTF), and color remaining (residual color) after processing according to the following test methods. The results obtained are shown in Table 1.

(a) Relative Sensitivity

The sample was exposed to light of a 400 lux tungsten lamp for 1/10 second through an optical wedge and developed at 20° C. for 7 days using a developer of the following formulation.

| Developer Formulation: | |
|---|---|
| Metol | 2 g |
| Sodium Sulfite | 100 g |
| Hydroquinone | 5 g |
| Borax.10 $H_2O$ | 2 g |
| Water to make | 1 liter |

After fixation (with "Fuji Fix" produced by Fuji Photo Film Co., Ltd.), washing, and drying, photographic sensitivity was measured at a given density higher than the fog base density (optical density of 0.2).

(b) MTF (Modulation Transfer Function)

The sample was processed by the same manner as in (a) above, and MTF was determined at an aperture of 400 μm×2 μm in accordance with the method described in T. H. James (ed.), *The Theory of the Photographic Process*, 592–618 (Macmillan, 1977). The evaluations were made quantitatively in terms of spatial frequency providing an MTF value of 0.5.

(c) Residual Color

After the sample was processed by the same manner as in (a) above, residual color was visually evaluated and rated as follows.

A: Acceptable
B: Slightly acceptable
C: Slightly unacceptable
D: Unacceptable

TABLE 1

| Sample No. | Antihalation Layer: Mordant Kind | Mordant Amount (g/m$^2$) | Dye Kind | Dye Amount (mg/m$^2$) | Residual Color Reducing Agent: Kind | Amount (g/m$^2$) | Layer | Relative Sensitivity | MTF$^{0.5}$ | Color Remaining |
|---|---|---|---|---|---|---|---|---|---|---|
| I-1 | — | — | — | — | — | — | — | 100 | 25 | A |
| I-2 | E-1 | 0.16 | D-8<br>D-51 | 24<br>15 | — | — | — | 100 | 38 | C |
| I-3 | " | " | D-51 | 15 | P-2 | 0.18 | First emulsion layer | 100 | 38 | B |
| I-4 | " | " | " | " | " | 0.4 | First emulsion layer | 98 | 38 | A |

TABLE 1-continued

| Sample No. | Antihalation Layer Mordant Kind | Antihalation Layer Mordant Amount ($g/m^2$) | Antihalation Layer Dye Kind | Antihalation Layer Dye Amount ($mg/m^2$) | Residual Color Reducing Agent Kind | Residual Color Reducing Agent Amount ($g/m^2$) | Residual Color Reducing Agent Layer | Relative Sensitivity | $MTF^{0.5}$ | Color Remaining |
|---|---|---|---|---|---|---|---|---|---|---|
| I-5 | (VIII) | 0.16 | " | " | — | — | — | 90 | 43 | C |
| I-6 | " | " | " | " | P-2 | 0.18 | First emulsion layer | 88 | 42 | B |
| I-7 | " | " | " | " | " | 0.4 | First emulsion layer | 82 | 44 | A |

Mordant:
E-1 (latex)

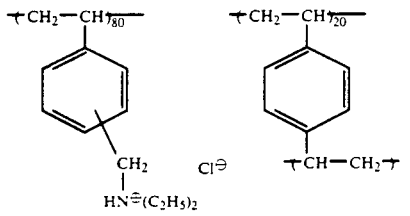

Dye:
D-8

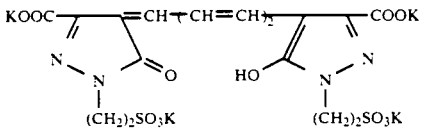

D-51

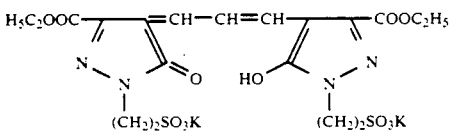

As is apparent from the results of Table 1, samples containing the residual color reducing agent according to the present invention were free from residual color, while retaining their inherent sensitivity. It was confirmed that such effects are particularly remarkable when in using latex mordants.

EXAMPLE 2

A 175 μm thick polyethylene terephthalate film having been blued and biaxially stretched was subjected to corona discharge treatment, and a coating composition for a first subbing layer having the following composition was coated thereon to a coverage of 5.1 $ml/m^2$ with a wire bar coater and dried at 175° C. for 1 minute. The same composition was also coated on the opposite side in the same manner.

| First Subbing Layer: | |
|---|---|
| Butadiene-Styrene Copolymer (31/69 by weight) Latex Solution (solid content: 40 wt %) | 79 ml |
| 2,4-Dichloro-6-hydroxy-s-triazine Sodium Salt 4 wt % Solution | 20.5 ml |
| Distilled Water | 900.5 ml |

*The latex solution contained a compound of formula:

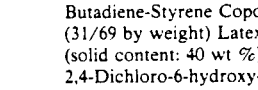

as an emulsifier in an amount of 0.4 wt % based on the solid content of the latex.

A coating composition for a second subbing layer having the composition shown in Table 2 was coated on each of the first subbing layers to a coverage of 8.5 $ml/m^2$ and dried to obtain a film having a double-layered subbing layer on each side thereof.

Preparation of Emulsion

To 1 liter of water were added 5 g of potassium bromide, 0.05 g of potassium iodide, 30 g of gelatin, and 2.5 ml of a 5% aqueous solution of a thioether $[HO(CH_2)_2S(CH_2)_2S(CH_2)_2OH]$, and the resulting solution was kept at 75° C. To the solution were added an aqueous solution of 8.33 g of silver nitrate and an aqueous solution containing 5.94 g of potassium bromide and 0.72 g of potassium iodide while stirring over a period of 45 seconds according to a double jet process. To the mixture was added 2.5 g of potassium bromide. Then, an aqueous solution containing 8.33 g of silver nitrate was added over 7.5 minutes in such a manner that the fed rate at the end of addition was twice the feed rate at the start. Subsequently, an aqueous solution of 153.34 g of silver nitrate and an aqueous solution of 107 g of potassium bromide were added thereto over 25 minutes while maintaining a pAg of 8.1 according to a controlled double jet process at such a feed rate that the feed rate at the end of addition was 8 times the feed rate at the start. After completion of addition, 15 ml of a 2N aqueous solution of potassium thiocyanate, and 50 ml of a 1% aqueous solution of potassium iodide was further added thereto over 30 seconds. The temperature was lowered to 35° C., and soluble salts were removed by a sedimentation method. The temperature was raised to 40° C., and 68 g of gelatin, 2 g of phenol, and 7.5 g of trimethylolpropane were added thereto. The resulting emulsion was adjusted to a pH of 6.55 with sodium hydroxide and a pAg of 8.10 with potassium bromide.

After elevating the temperature to 56° C., 735 mg of a sensitizing dye of the following formula:

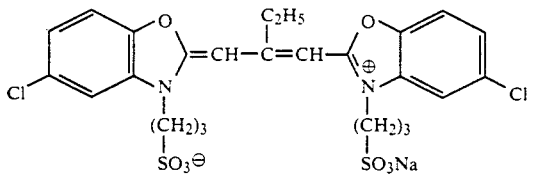

was added to the emulsion. Ten minutes later, 5.5 mg of sodium thiosulfate pentahydrate, 163 mg of potassium thiocyanate, and 3.6 mg of chloroauric acid were added thereto and, 5 minutes later, the emulsion was rapidly cooled to solidify. The thus prepared emulsion was found to contain grains having an aspect ratio of 3 or more in a proportion of 93% based on the total projected area of total grains. All the grains having an aspect ratio of 2 or more had an average projected area diameter of 0.83 μm, a standard deviation of 18.5%, and average thickness of 0.161 μm, and an aspect ratio of 5.16.

Preparation of Light-Sensitive Material

A coating composition was prepared by adding the following compounds to the above-prepared emulsion in amounts shown per mol of silver halide.

| | |
|---|---|
| 4-Hydroxy-6-methyl-1,3,3a,7-tetraazaindene | 1.94 g |
| 2,6-Bis(hydroxyamino)-4-diethylamino-1,3,5-triazine | 80 mg |
| Sodium Polyacrylate (average molecular weight: 41,000) | 4.0 g |
| 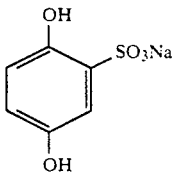 | 9.7 g |
| Ethyl Acrylate/Acrylic Acid/Methacrylic Acid Copolymer (95/2/3) as a Plasticizer | 20.0 g |
| Nitron | 50 mg |
| 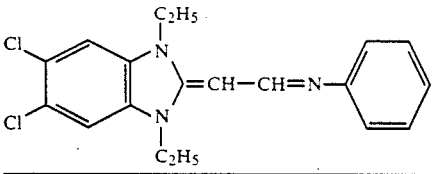 | 5.0 mg |

The resulting coating composition was coated on both sides of the above-described support to a silver coverage of 1.9 g/m² (gelatin coverage: 1.5 g/m²) simultaneously with a coating composition for a protective layer having the following formulation by coextrusion.

| Surface Protective Layer: | |
|---|---|
| Gelatin | 0.81 g/m² |
| Dextran (average molecular weight: 39,000) | 0.81 g/m² |
| Methyl Methacrylate/Methacrylic Acid Copolymer (9/1) Particles (average particle size: 3.5 μm) as a Matting Agent | 0.06 g/m² |

-continued

| Surface Protective Layer: | |
|---|---|
| 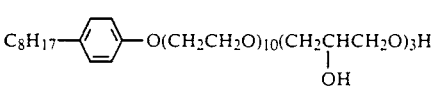 | 60 mg/m² |
| 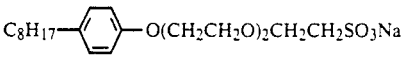 | 20 mg/m² |
| $C_8F_{17}SO_2N(C_3H_7)(CH_2CH_2O)_4(CH_2)_4SO_3Na$ | 2 mg/m² |
| $C_8H_{17}SO_2N(C_3H_7)(CH_2CH_2O)_{15}H$ | 5 mg/m² |
| Sodium Polyacrylate (average molecular weight: 41,000) | 70 mg/m² |

In addition, 75 mg/m² of 1,2-bis(sulfonylacetamido)ethane as a hardening agent was coated on the above layer.

The resulting light-sensitive materials were designated as Samples II-1 to II-5.

For comparison, Sample II-6 was prepared in the same manner as for Sample II-5, except that an interlayer having the following composition was coated between the subbing layer and the emulsion layer by coextrusion of the surface protective layer/emulsion layer/interlayer.

| Interlayer | Per Single Layer |
|---|---|
| Gelatin | 0.8 g/m² |
| Mordant: (V) | 52.7 mg/m² |
| Dye: D-71 | 16.1 mg/m² |
| 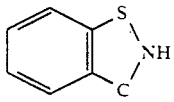 | 2.98 mg/m² |

Evaluation of Photographic Performance

A radiographic intensifying screen ("GRE NEX Ortho Screen G-4" produced by Fuji Photo Film Co., Ltd.) was brought into intimate contact with each side of each of Samples II-1 to II-6 in a cassette. The sample was exposed to X-rays for sensitometry. The exposure amount was controlled by varying the distance between an X-ray tube and the cassette. After the exposure, the sample was automatically processed according to the following procedure.

| Step | Temperature (°C.) | Time (sec) | Tank Volume (l) |
|---|---|---|---|
| Development | 35 | 12.5 | 6.5 |
| Fixation | 35 | 10 | 6.5 |
| Washing | 20 | 7.5 | 6.5 |
| Drying | 50 | | |

Dry-to-dry time: 48 seconds

The developer and fixer used had the following compositions.

| Developer Composition: | |
|---|---|
| 1-Phenyl-3-pyrazolidone | 3.0 g |
| Hydroquinone | 30 g |

-continued

| | |
|---|---|
| 5-Nitroindazole | 0.25 g |
| Potassium Bromide | 3.0 g |
| Anhydrous Sodium Sulfite | 50 g |
| Potassium Hydroxide | 30 g |
| Boric Acid | 10 g |
| Glutaraldehyde | 5 g |
| Water to make | 1 l |
| pH adjusted to 10.20 | |
| Fixer Composition: | |
| Ammonium Thiosulfate | 200 g |
| Anhydrous Sodium Sulfite | 20 g |
| Boric Acid | 8 g |
| Disodium Ethylenediaminetetraacetic Acid | 0.1 g |
| Aluminum Sulfate | 15 g |
| Sulfuric Acid | 2 g |
| Glacial Acetic Acid | 22 g |
| Water to make | 1 l |
| pH adjusted to 4.30 | |

(a) Relative Sensitivity

Photographic sensitivity was relatively expressed, taking the result of Sample II-1 as a standard (100).

(b) Drying Properties

The sample was developed, fixed, and washed in the same manner as in (a) above, except that the washing water had a temperature of 14° C. After the sample was squeezed, it was taken out of the automatic developing machine just before it was forwarded to a drying zone. Hot air was blown onto the sample by means of a commercially available drier, and the time required for the surface temperature of the sample to rise to 30° C. was measured by means of a surface thermometer.

(c) Sharpness (MTF)

The sample automatically processed in the same manner as in (a) above was evaluated for MTF using an aperture of 30 μm×500 μm. The evaluation was made at the area having an optical density of 1.0 by using an MTF value at a spatial frequency of 1.0 c/mm.

(d) Residual Color

The sample was automatically processed in the same manner as in (a) above, and the residual color of the processed sample was visually evaluated and rated as follows.

G: Good
B: Bad
M: Medium between G and B

The results obtained are shown in Table 3 below.

TABLE 2

| Composition of Second Subbing Layer | Sample No. | | | | |
|---|---|---|---|---|---|
| | Comparison | | | Invention | |
| | II-1 | II-2 | II-3 | II-4 | II-5 |
| Gelatin (g) | 10 | 10 | 10 | 10 | 10 |
| 20 wt % Solution of Polymer Latex (V) (ml) | — | — | 31 | 31 | 47 |
| 20 wt % Solution (ml) of: | — | 31 | — | — | — |

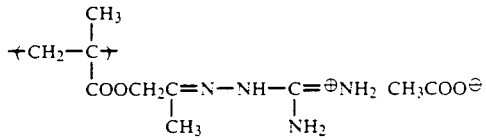

| | | | | | |
|---|---|---|---|---|---|
| Dye: 3 wt % Aqueous Solution of D-71 (ml) | — | — | 63 | 63 | 95 |
| 3 wt % Solution (ml) of: | — | 63 | — | — | — |

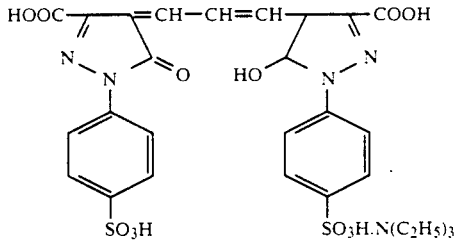

| | | | | | |
|---|---|---|---|---|---|
| Nonionic Surfactant: 1% Aqueous Solution of III-26 (ml) | 10 | 10 | 10 | 10 | 10 |
| Matting Agent: Polymethyl Methacrylate (average particle size: 2.5 μm) (g) | 0.3 | 0.3 | 0.3 | 0.3 | 0.3 |
| 3.5 wt % Aqueous Solution (ml) of: | 1 | 1 | 1 | 1 | 1 |

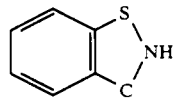

| | | | | | |
|---|---|---|---|---|---|
| 14.5 wt % Aqueous Solution of Carboxylic Acid Polymer P-I-1 (ml) | — | — | — | 10 | 10 |
| Water to make (liter) | 1 | 1 | 1 | 1 | 1 |

TABLE 3

| Sample No. | Relative Sensitivity | Drying Properties (sec) | MTF | Residual Color | Remarks |
|---|---|---|---|---|---|
| II-1 | 100 | 19 | 0.73 | G | Comparison |
| II-2 | 88 | 20 | 0.75 | M | " |
| II-3 | 92 | 19.5 | 0.77 | M | " |

TABLE 3-continued

| Sample No. | Relative Sensitivity | Drying Properties (sec) | MTF | Residual Color | Remarks |
|---|---|---|---|---|---|
| II-4 | 92 | 20 | 0.77 | G | Invention |
| II-5 | 90 | 20 | 0.79 | G | " |
| II-6 | 85 | 27 | 0.75 | M | Comparison |

As is apparent from the results of Table 3, MTF was improved without reducing the sensitivity and increasing the drying load according to the present invention. Thus, the present invention provides an excellent light-sensitive material having freedom from residual color.

While the invention has been described in detail and with reference to specific embodiments thereof, it will be apparent to one skilled in the art that various changes and modifications can be made therein without departing from the spirit and scope thereof.

What is claimed is:

1. A light-sensitive material comprising a support having thereon at least one light-sensitive silver halide emulsion layer, wherein at least one layer containing a mordant and a dye are provided on at least one side of said support; and at least one layer which is provided on the same side of said layer containing the mordant and dye contains a water-soluble ionic polymer as an agent for reducing color remaining, wherein said water-soluble ionic polymer is present in an amount of from 0.01 to 1 g/m$^2$ and is a synthetic water-soluble polymer containing a repeating unit represented by formula (P):

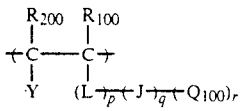

(P)

wherein $R_{100}$ and $R_{200}$, which may be the same or different, each represents hydrogen, a substituted or unsubstituted alkyl group, a halogen atom, or —$CH_2COOM$, wherein M represents hydrogen or a cation;

L represents —CONH—, —NHCO—, —COO—, —OCO—, —CO—, —$SO_2$—, —$NHSO_2$—, —$SO_2NH$—, or —O—;

J represents a substituted or unsubstituted alkylene group, a substituted or unsubstituted arylene group, a substituted or unsubstituted aralkylene group, —$(CH_2CH_2O)_m$—$(CH_2)_n$—, or

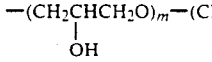

wherein m is 0 or an integer of from 1 to 40, and n is 0 or an integer of from 1 to 4;

$Q_{100}$ represents —COOM, —$SO_3M$,

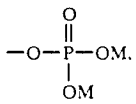

or —OM, wherein M represents hydrogen or a cation;

p and q each is 0 or 1;

r is an integer; and

Y represents hydrogen, a carboxyl group or a salt thereof; and wherein said mordant is present in an amount of 5 to 500 mg/m$^2$ and is an anion exchange copolymer latex represented by formula (II):

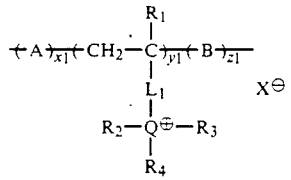

(II)

wherein

A represents an ethylenically unsaturated monomer unit;

$R_1$ represents hydrogen or a lower alkyl group having from 1 to about 6 carbon atoms;

$L_1$ represents a divalent group having from 1 to about 12 carbon atoms;

$R_2$, $R_3$, and $R_4$, which may be the same or different, each represents a substituted or unsubstituted alkyl group having from 1 to about 20 carbon atoms, a substituted or unsubstituted aralkyl group having from 7 to about 20 carbon atoms, or hydrogen, with the proviso that one of and only one of $R_2$, $R_3$, and $R_4$ is a hydrogen atom, and $R_2$, $R_3$, and $R_4$ may be linked to form a cyclic structure;

$Q^{\oplus}$ represents N or P;

$X^{\ominus}$ represents an anion except for iodide;

$x_1$ is a copolymerization ratio from 0 to 90 mol %;

$y_1$ is a copolymerization ratio from 10 to 99.9 mol %;

$z_1$ is a copolymerization ratio from 0.1 to 50 mol %; and

B represents a structural unit derived from a copolymerizable monomer containing at least two ethylenically unsaturated groups wherein said dye is contained in an amount of from 5 to 400 mg/m$^2$ and is selected from oxonol dyes, azo dyes, anthraquinone dyes, allylidene dyes, styryl dyes, triarylmethane dyes, merocyanine dyes and cyanine dyes.

2. The light-sensitive material as claimed in claim 1, wherein said layer containing the mordant and dye is a subbing layer or a lowermost layer.

3. The light-sensitive material as claimed in claim 1, wherein said water-soluble ionic polymer is a polymer containing a carboxylic acid monomer unit.

4. The light-sensitive material as claimed in claim 1, wherein said synthetic water-soluble polymer has a molecular weight of from 1,000 to 1,000,000.

5. The light-sensitive material as claimed in claim 1, wherein said mordant is present in an amount of at least 0.1 cation site units per mol of the total dye contained in the light-sensitive material.

6. The light-sensitive material as claimed in claim 2, wherein said subbing layer further contains a nonionic surface active agent.

7. The light-sensitive material as claimed in claim 6, wherein said nonionic surface active agent is present in an amount of from 0.1 to 50 mg/m$^2$.

8. The light-sensitive material as claimed in claim 1, wherein said water-soluble ionic polymer is a polymer having a carboxylic acid monomer unit represented by formula (P-I):

$$\left(A_0\right)_a\left(B_0\right)_b \qquad \text{(P-I)}$$

wherein $A_0$ represents a monomer unit selected from acrylic acid, methacrylic acid, maleic acid, itaconic acid, carboxystyrene, alkali metal salts or ammonium salts of these carboxylic acids, and vinyl compounds represented by the following formula:

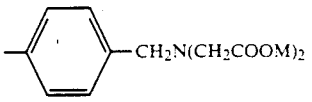

wherein M represents hydrogen or an alkali metal atom; $B_0$ represents a copolymerizable monomer unit different from $A_0$; a is a copolymerization ratio of from 50 to 100 mol %; and b is a copolymerization ratio of from 0 to 50 mol %.

9. The light-sensitive material as claimed in claim 8, wherein said polymer having a carboxylic acid monomer unit has an average molecular weight of from 2,000 to 500,000.

10. The light-sensitive material as claimed in claim 1, wherein at least 80% of the total amount of said dye is present in a layer nearer to the support than the light-sensitive layer.

11. The light-sensitive material as claimed in claim 1, wherein said light-sensitive material is an X-ray film.

* * * * *